US007350300B2

(12) United States Patent
Yamaguchi et al.

(10) Patent No.: US 7,350,300 B2
(45) Date of Patent: Apr. 1, 2008

(54) SHAVER

(75) Inventors: Takashi Yamaguchi, Hikone (JP); Yasunori Ueda, Hikone (JP); Kotaro Yanagi, Hikone (JP); Izumi Mihara, Daito (JP); Masahiro Takatani, Hirakata (JP); Tetsushi Ogawa, Higashiosaka (JP); Takumi Adachi, Yokohama (JP); Etsushi Muramatsu, Yokohama (JP); Tsuyoshi Nishizawa, Yokohama (JP); Takashi Yukawa, Kyoto (JP); Matsuki Yamamoto, Ashiya (JP); Fumio Taniguchi, Hikone (JP); Masanobu Yamasaki, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 161 days.

(21) Appl. No.: 10/511,605

(22) PCT Filed: Mar. 28, 2003

(86) PCT No.: PCT/JP03/04046

§ 371 (c)(1),
(2), (4) Date: Nov. 3, 2004

(87) PCT Pub. No.: WO03/101682

PCT Pub. Date: Dec. 11, 2003

(65) Prior Publication Data

US 2005/0229400 A1 Oct. 20, 2005

(30) Foreign Application Priority Data

May 30, 2002 (JP) ..... 2002-158079
Jun. 17, 2002 (JP) ..... 2002-176450
Oct. 31, 2002 (JP) ..... 2002-318927

(51) Int. Cl.
*B26B 19/38* (2006.01)

(52) U.S. Cl. ..... 30/43.92; 30/34.1; 30/43.9

(58) Field of Classification Search ..... 30/34.1, 30/43.6, 43.9, 43.92, 526, 43.4, 43.5, 43.7, 30/43.8, 43.91; D28/49, 51
See application file for complete search history.

(56) References Cited

U.S. PATENT DOCUMENTS 3,791,030 A * 2/1974 Jackson et al. ..... 30/43.9

(Continued)

FOREIGN PATENT DOCUMENTS

JP 63-65279 4/1988

(Continued)

OTHER PUBLICATIONS

English language Abstract of JP 5-23447, Feb. 1993.

(Continued)

*Primary Examiner*—Hwei-Siu C. Payer
(74) *Attorney, Agent, or Firm*—Greenblum & Bernstein, P.L.C.

(57) ABSTRACT

In a shaver having provided on an upper end portion of a main body thereof a head portion comprising a razor having an outer blade and an inner blade, a front cross section of the shaver has a shape narrowed at a substantially center portion in its up and down direction, and a side cross section of the shaver has a substantially S-shape, in order to increase the contact area between the main body and the palm, to improve fit feeling, to make it hard to slip, and to finely adjust the angle of the razor against the skin without moving the wrist.

20 Claims, 27 Drawing Sheets

U.S. PATENT DOCUMENTS

| | | | | | |
|---|---|---|---|---|---|
| D231,501 | S | * | 4/1974 | Steinkamp | D28/49 |
| 4,274,199 | A | * | 6/1981 | Gallanis et al. | 30/34.1 |
| 5,031,319 | A | * | 7/1991 | Althaus et al. | 30/526 |
| 5,386,631 | A | * | 2/1995 | Van Asten et al. | 30/34.1 |
| 5,524,345 | A | * | 6/1996 | Eichhorn | 30/34.1 |
| 5,539,984 | A | * | 7/1996 | Ikuta et al. | 30/43.92 |
| D386,822 | S | * | 11/1997 | Van Scoyoc et al. | D28/49 |
| 5,903,978 | A | * | 5/1999 | Prochaska et al. | 30/34.05 |
| D429,377 | S | * | 8/2000 | Allende | D28/49 |
| D441,912 | S | * | 5/2001 | Micinilio | D28/51 |
| 6,305,083 | B1 | * | 10/2001 | Rijken et al. | 30/43.6 |
| 6,317,982 | B1 | * | 11/2001 | Andrew | 30/34.1 |
| 6,405,439 | B1 | * | 6/2002 | Malobabic et al. | 30/43.92 |
| D463,883 | S | * | 10/2002 | van Asten | D28/51 |
| 7,020,966 | B2 | * | 4/2006 | Shiba et al. | 30/43.92 |
| 2001/0050463 | A1 | | 12/2001 | Ito | |
| 2003/0029042 | A1 | * | 2/2003 | Wilcox | 30/34.1 |
| 2004/0010919 | A1 | | 1/2004 | Shiba et al. | |
| 2006/0021228 | A1 | * | 2/2006 | Shiba et al. | 30/43.92 |

FOREIGN PATENT DOCUMENTS

| | | |
|---|---|---|
| JP | 5-23447 | 2/1993 |
| JP | 7-185142 | 7/1995 |
| JP | 2001-190867 | 7/2001 |
| JP | 2002-95878 | 4/2002 |
| WO | 00/24565 | 5/2000 |

OTHER PUBLICATIONS

English language Abstract of JP 2002-095878, Apr. 2002.
English language Abstract of JP2001-190867, Jul. 2001.
English language Abstract of JP7-185142, Jul. 1995.

* cited by examiner 3
1
2

6
4
3
31A
31B
1
10
2

3
4
6
1
2

3
1
6
4

SHAVER

TECHNICAL FIELD

The present invention relates to a shaver (electric razor) having a shape that is easy to use and easy to hold during use.

BACKGROUND ART

A basic configuration of a shaver is configured by a head portion having a razor and a main body which has a built-in driving unit and a built-in power supply unit, and which serves as a grip portion. The head portion is provided on an upper end portion of the main body. Generally, the head portion is positioned on the vertical line of the main body. In many cases, shape of the main body is substantially an elliptical cylinder, and cross sectional shapes of the front, side and plan views are axial symmetry.

According to such shape of the main body as described above, when the main body is held by hand, gaps are produced between the main body and the irregularities of the palm, whereby enough fit feeling to the hand and holding performance cannot be obtained. Further, since it is easy to slip and has low holdability, there is a problem that it is unable to shave with an optimum pressing force due to the hand is overpowered by the pressing force and slips on the main body, when pressing the razor of the head portion against the skin. Furthermore, many actions of the arm, the elbow and the like are necessary to press the razor of the head portion at an optimum angle against the skin, so that the shaving operation becomes laborious.

On the other hand, a shaver having a shape different from such described above are known, in which an axis of the head portion is intersected with an axis of the grip portion for forming a neck at a connecting portion between the head portion and the grip portion (refer to e.g. Japanese laid-open patent publication Hei 5-23447). Furthermore, one having a substantially S-shape as seen from the side is also known (refer to e.g. Japanese laid-open patent publication Hei 7-185142).

However, even though the shavers are formed in such shapes as shown in the above patent publications, the contact area between the main body and the palm cannot be increased enough. Further, it is difficult to obtain good fit feeling, and it is easy to slip. In addition, according to such prior arts, it is required to move the wrist for adjusting the angle of the razor against the skin, which requires redundant actions. Since the angle adjustment is performed by moving the wrist, there is a problem that it is difficult to finely adjust the angle of the razor against the skin.

DISCLOSURE OF INVENTION

The present invention has been made in view of the above-described problems, and it is objected to provide a shaver that is easy to use, by which the contact area between the main body and the palm is increased, the fit feeling is increased, it is hard to slip, and the fine adjustment of the angle of the razor against the skin can be easily performed without moving the wrist.

In order to solve the above problems, the present invention is a shaver provided a head portion comprising a razor having an outer blade and an inner blade on an upper end portion of a main body thereof, characterized by that a front cross section of the shaver in its entirety has a torso shape having a neck portion narrowed in width at a substantially center portion in up and down direction of the shaver, and a side cross section of the shaver in its entirety has a substantially S-shape.

By forming the shape of the entire shaver in this manner, it is possible to increase contact area of the main body of the shaver with a portion between the index finger and the thumb, when the shaver is held by the thumb and the index finger. Furthermore, owing to a back concave curved portion on a lower back part in the substantially S-shape, it is possible to secure contact area with the hypothenar of the hand regardless of the size of the hand. In this way, the contact area with the hypothenar and the portion between the index finger and the thumb, which is important to stably hold the shaver, can be secured, so that the convex curve of the thenar fits the torso-shaped neck portion when gripping and holding it, thereby making it possible to grip and hold it without unreasonable effort.

BEST MODES FOR CARRYING OUT THE INVENTION

First Embodiment

Figure 1:
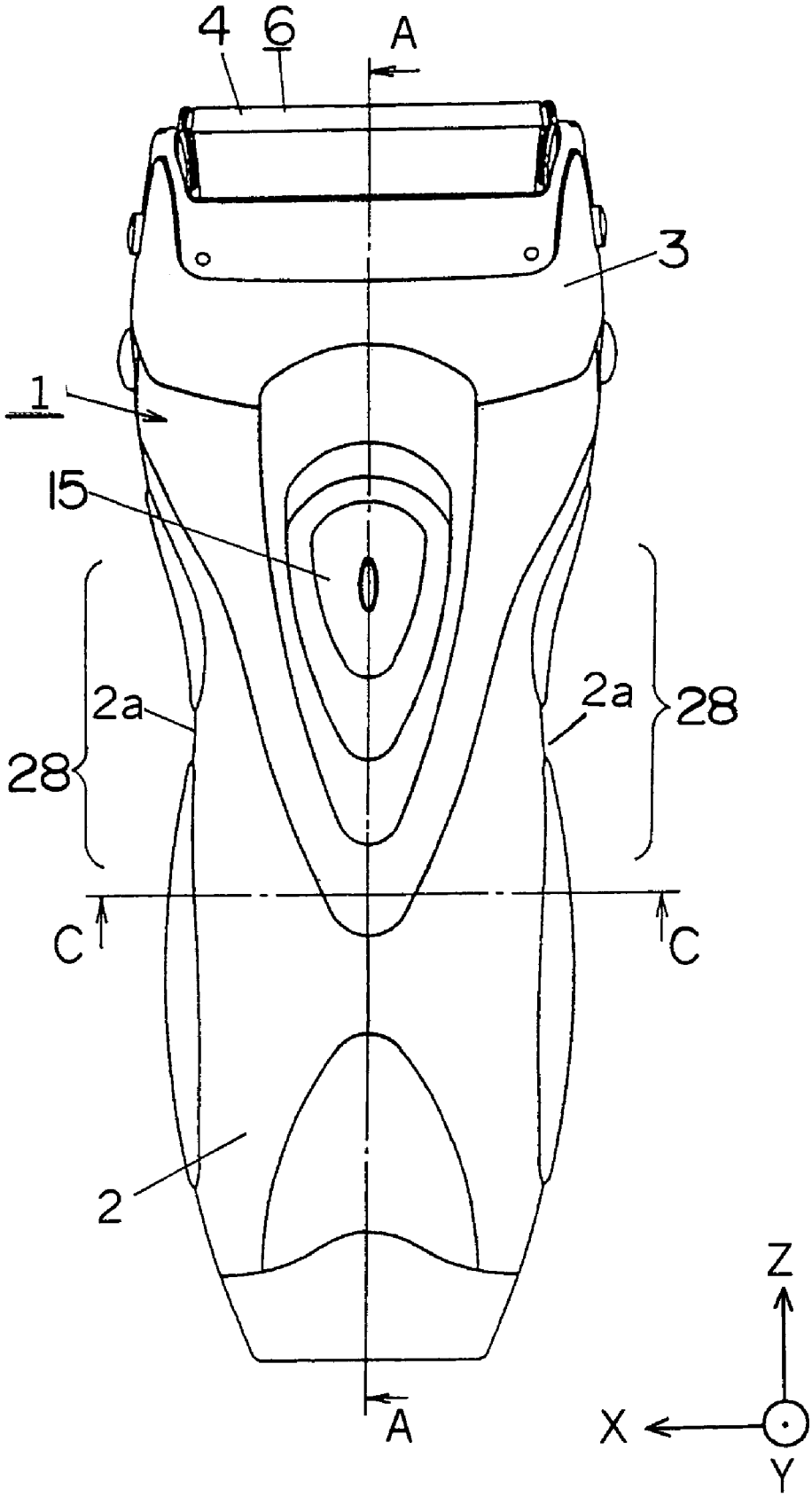
FIG. 1 is a front view showing the shape of a shaver in accordance with a first embodiment of the present invention.
Figure 2:
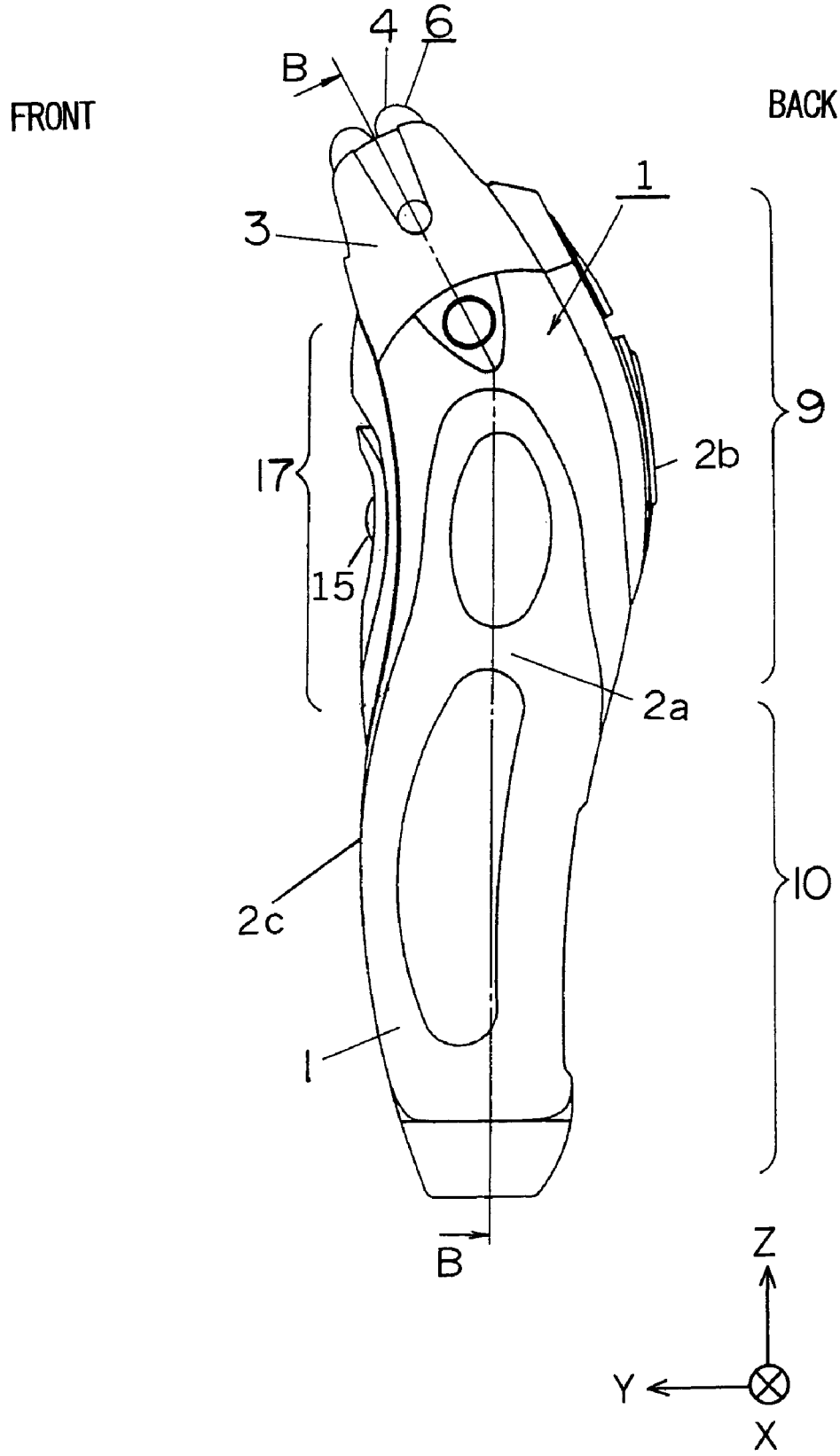
FIG. 2 is a side view of the shaver in accordance with the first embodiment shown in FIG. 1.
Figure 3:
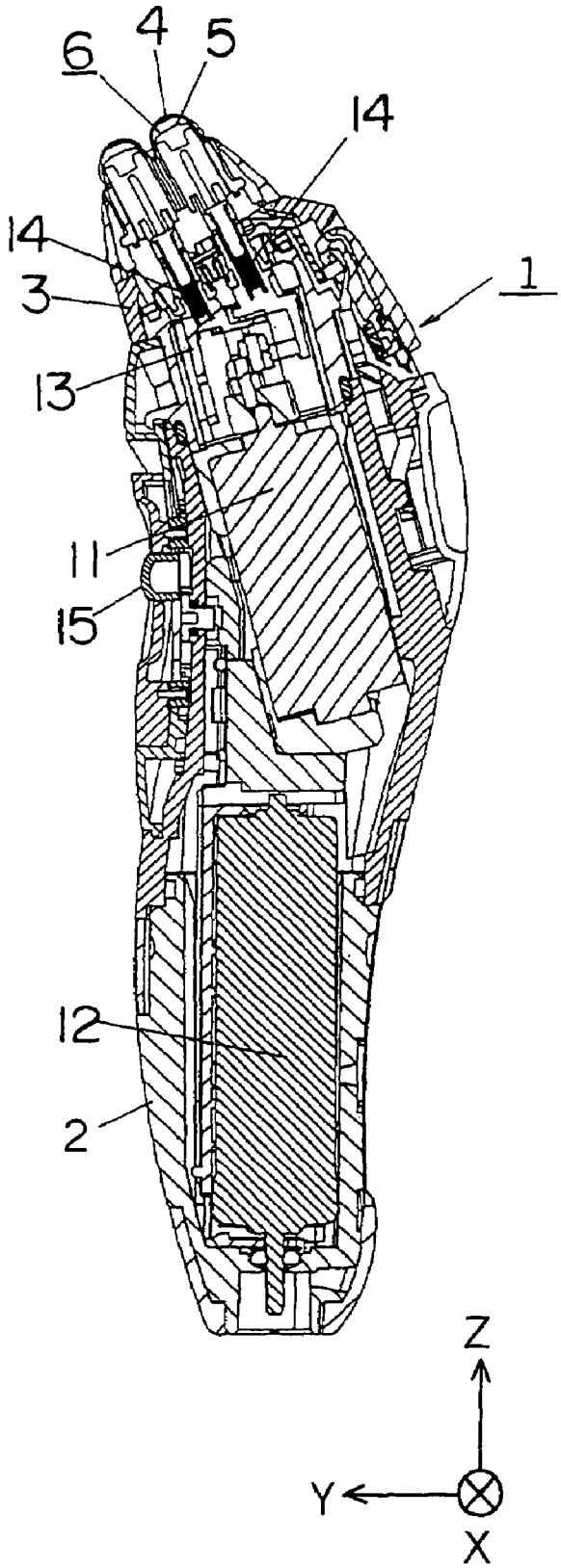
FIG. 3 is a cross sectional view along the A-A line in FIG. 1.
Figure 4:
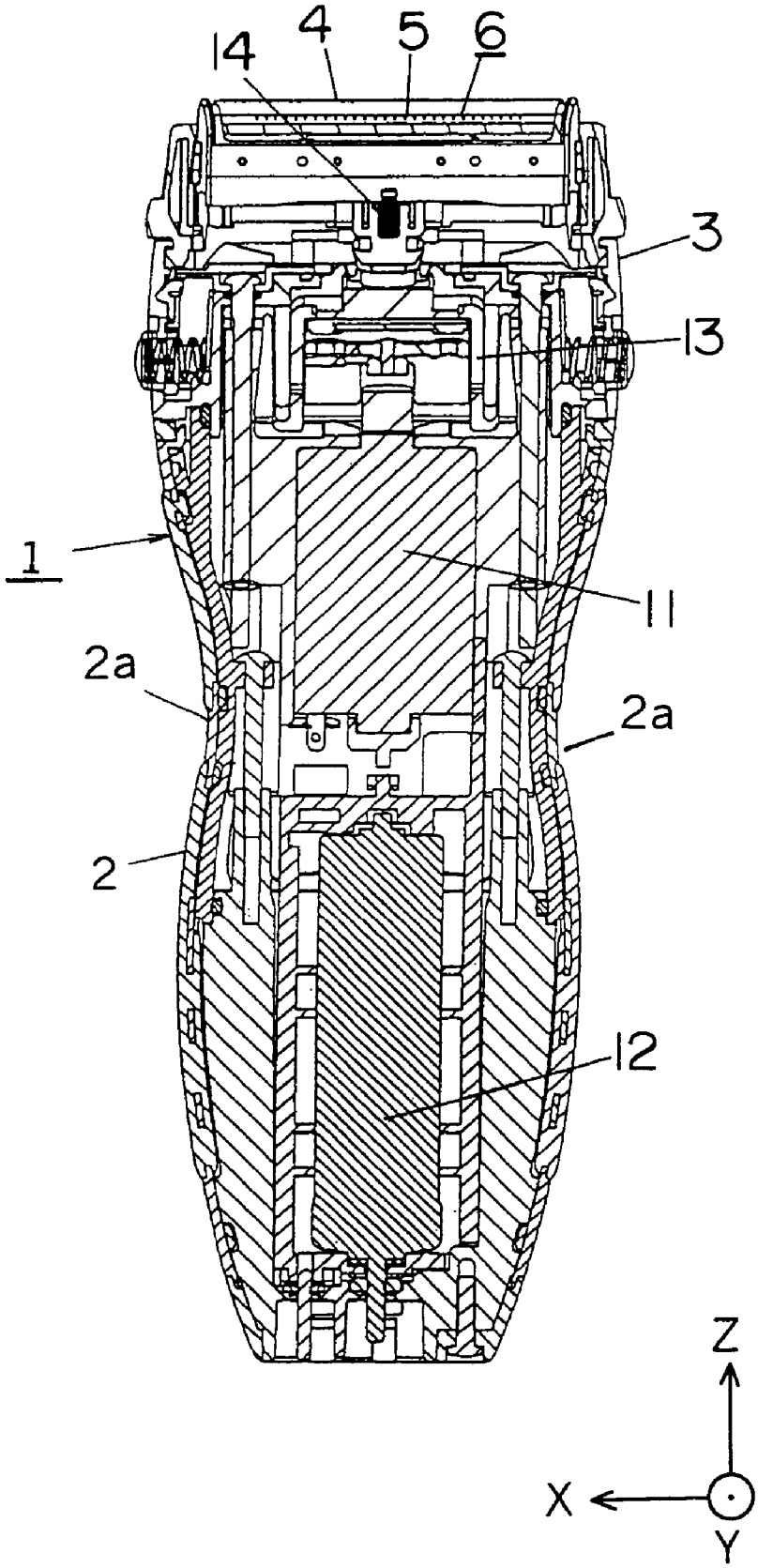
FIG. 4 is a cross sectional view along the B-B line in FIG. 2.

Hereinafter, a first embodiment of the present invention will be described with reference to the drawings. FIG. 1 shows a front view of a shaver in accordance with the first embodiment, while FIG. 2 shows its side view. FIG. 3 shows a cross sectional view along the A-A line of FIG. 1, while FIG. 4 shows a cross sectional view along the B-B line of FIG. 2.

As shown in the drawings, the shaver 1 comprises a main body 2, a head portion 3 provided on an upper end of the main body 2, a switch unit 15 provided on the front of the main body 2, and so on. An electric motor 11, a power supply unit 12 to drive the electric motor 11, driving elements 13 to convert the rotational motion of the electric motor 11 into reciprocating motion, and so on are provided inside of the main body 2.

A razor 6 having outer blades 4 and inner blades 5 is provided on an upper end (leading end) of the head portion 3. In the razor 6 in accordance with the present embodiment, the inner blade 5 is configured by a reciprocating blade to reciprocatingly move. The head portion 3 has a flat and substantially rectangular plan cross sectional shape, whose lengthwise direction is the reciprocating direction (X-direction (left and right direction) in FIG. 1 and FIG. 4) of the inner blade 5. As shown in FIG. 3, each of the outer blades 4 and the inner blades 5 of the razor 6 has a shape of substantially semicircular cross section in the Y-direction (forward and backward direction). The inner blades 5 are in contact with and pressed against the outer blades 4 by springs 14. The outer blades 4 are meshed and cut the beard in a manner so that the outer blades 4 are pressed to human skin, and that the beard is introduced to the inside through meshed blade holes of the outer blades 4, and further that the beard inside the outer blades 4 is nipped and cut by the inner blades 5 and the outer blades 4.

As can be seen from FIG. 1, the front of the shaver 1 has a torso shape in which its width in the X-direction is narrowed at a substantially center portion in the Z-direction (up and down direction). Further, as can be seen from FIG. 2, the entire shape of the side of the shaver 1 is substantially S-shaped. Hereupon, the position of a neck portion (the narrowed width portion) 2*a* having the torso shape is positioned between a vertex 2*b* of an upper bent portion (sic) and a vertex 2*c* of a lower bent portion (sic) on the side of the shaver 1, which is bent in the substantially S-shape.

As shown in FIG. 2, a back face of the main body 2 comprises an upper back convex curved portion 9 and a lower back concave curved portion 10 so as to have a substantially S-shape. A front concave curved portion 17 on an upper front portion of the main body 2 is positioned at a front side corresponding to the back convex curved portion 9. The head portion 3 is provided to extend forward diagonally from the upper end of the main body 2.

Figure 5A:
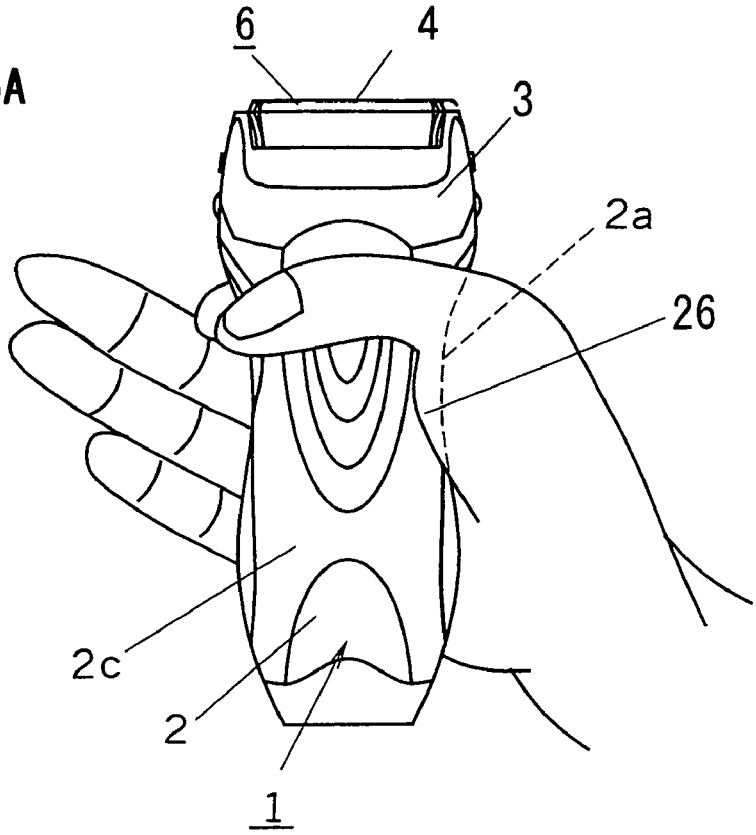
FIG. 5A and FIG. 5B are respectively front views showing a process to grip and hold of the shaver in accordance with the first embodiment.
Figure 5B:
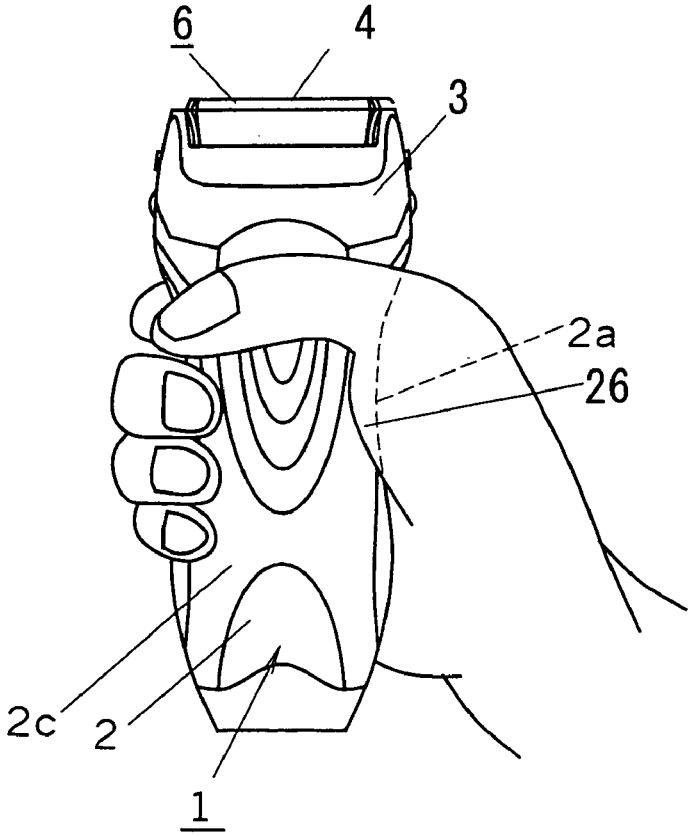

A process to grip and hold the shaver 1 is shown FIG. 5A and FIG. 5B. As shown in FIG. 5A, the vicinity of the upper bent portion 2*b* of the substantially S-shape on the upper part of the main body 2 is firmly pinched by an index finger and a thumb, firstly. Simultaneously, a hypothenar 19 is contacted with the back concave curved portion 10 on the lower back part of the main body 2. Furthermore, the convex curve of a thenar 26 is contacted with the torso-shaped neck portion 2*a*. In such manner, the hand of a user naturally fits the shaver 1. Under a condition that the shaver 1 is held by such a manner, as shown in FIG. 5, a middle finger and a ring finger are contacted along the torso-shaped neck portion 2*a*, and a little finger is contacted along the vicinity of the lower bent portion 2*c* of the substantially S-shape. In this way, when gripping and holding it, it gets to a state where mainly the index finger and the thumb holds the shaver 1, while the other fingers naturally contact along the shape of the shaver 1, the front of which is torso-shaped and the side of which is substantially S-shaped.

As can be seen from FIG. 5, the main body 2 serves as a grip except a portion where a width in the X-direction in the vicinity of its upper end is made wider. As described above, the entire shape of the side of the shaver 1 is substantially S-shaped. However, the part of the main body which part functions as the grip portion has a cross section in a substantially herringbone shape. The head portion 3 is provided to extend upward diagonally, at the side of the vertex of the substantially herringbone shape (the same as the vertex of the lower bent portion 2*c* of the substantially S-shape), from the upper end of the part of the main body 2 which part functions as the grip portion.

Figure 6:
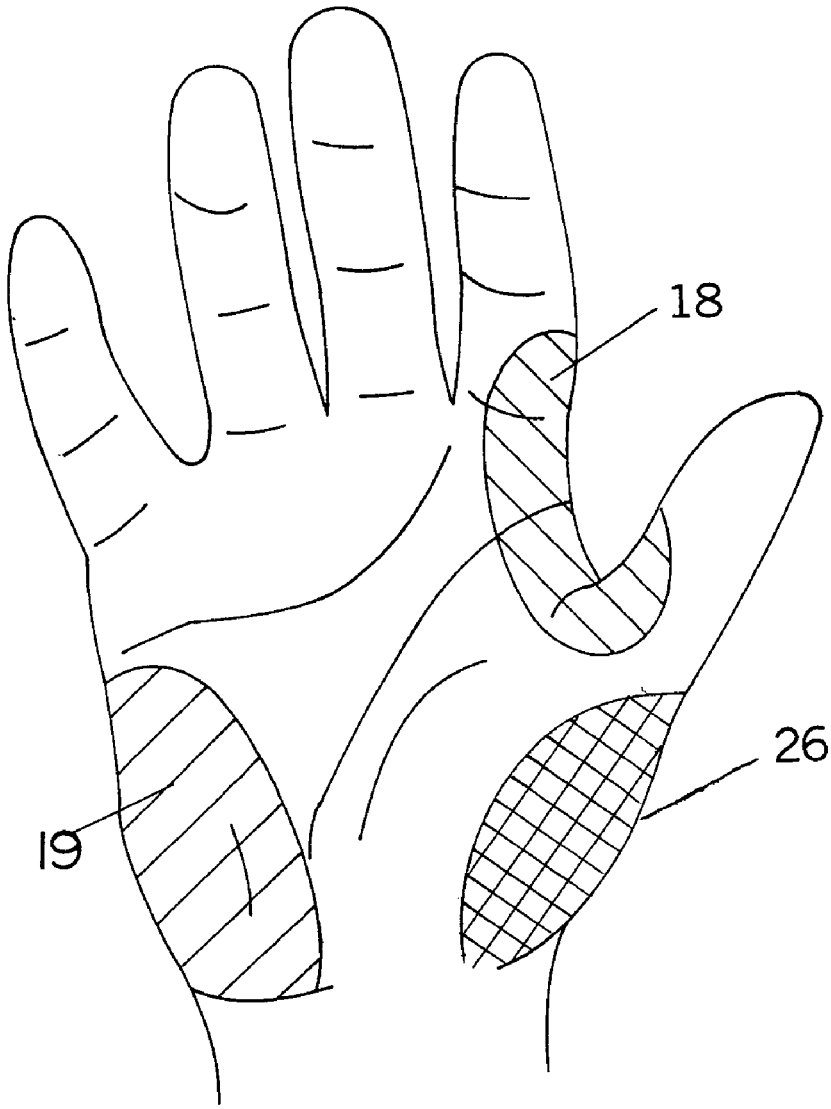
FIG. 6 is an explanatory view of regions of the hand.

Thus, the shaver 1 is shaped to have a front cross section in the torso shape in which its width in the X-direction is narrowed at a substantially center portion in the Z-direction, and further to have a side cross section in the substantially S-shape. Accordingly, the back convex curved portion 9 on the upper back part of the main body 2 contacts with a portion 18 of the hand between the index finger and the thumb as shown in FIG. 6, so that the contact area is increased as compared with shavers in conventional shapes. Besides, regardless of the size of the hand, the back concave portion 10 on the lower back part of the main body 2 contacts with the hypothenar 19 shown in FIG. 6, thereby increasing the contact area. As a result, the contact area with the above-described respective portions 18 and 19, which is important to stably hold the shaver 1, is secured, making it possible to stably hold the shaver 1. In addition, when it is gripped and held, the torso-shaped neck portion 2*a* fits the convex curve of the thenar 26 shown in FIG. 6, so that the convex curve of the thenar 26 is not strongly pressed, and it possible to grip and hold the shaver 1 without unreasonable effort.

Accordingly, in the case where the shaver 1 is gripped and held in such manner, it is possible finely to adjust the angle of the razor 6 of the head portion 3 of the shaver 1 against the skin in the following way. That is, as shown in FIG. 5A, the shaver 1 is held by being gripped mainly by the index finger and the thumb. Thus, using the part gripped by the thumb and the index finger as a fulcrum, it is possible to pivot the shaver 1 slightly in the forward and backward direction or the left and right direction in a manner that the middle finger, the ring finger, the little finger and the like contacting along the torso-shaped neck portion 2*a* and the vicinity of the lower bent portion 2*c* of the substantially S-shape press the neck portion 2*a* and the vicinity of the lower bent portion 2*c* of the substantially S-shape which is convex to the front. Hence, fine adjustment of the angle of the razor 6, provided at the upper end of the head portion 3, against the skin can be easily performed. At this time, since the convex curve of the thenar 26 fits the torso-shaped neck portion 2*a,* the convex curve portion of the thenar 26 is not strongly pressed against the side of the shaver 1, so that its pivoting, with the part gripped by the thumb and the index finger being used as a fulcrum, is not impeded by the thenar 26. Further, fine adjustment of the angle of the razor 6 against the skin can be easily performed without moving the wrist.

Figure 7:
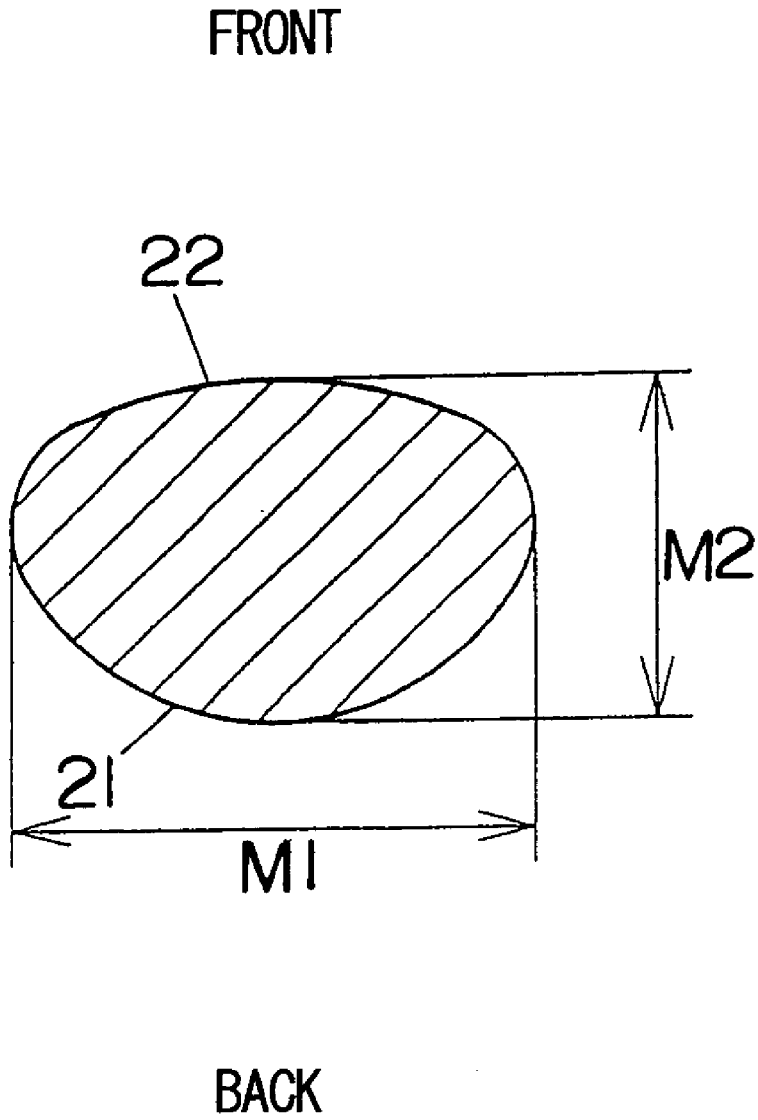
FIG. 7 is a cross sectional view along the C-C line in FIG. 1.

FIG. 7 shows a shape of a plan cross section of the main body 2 that is cut along the C-C line of FIG. 1. As shown in FIG. 7, the shape of the plan cross section of the main body 2 is designed to have a substantially ovoid shape such that a convex curve 21 on the back side has a larger curvature than the curvature of a convex curve 22 on the front side.

Figure 8:
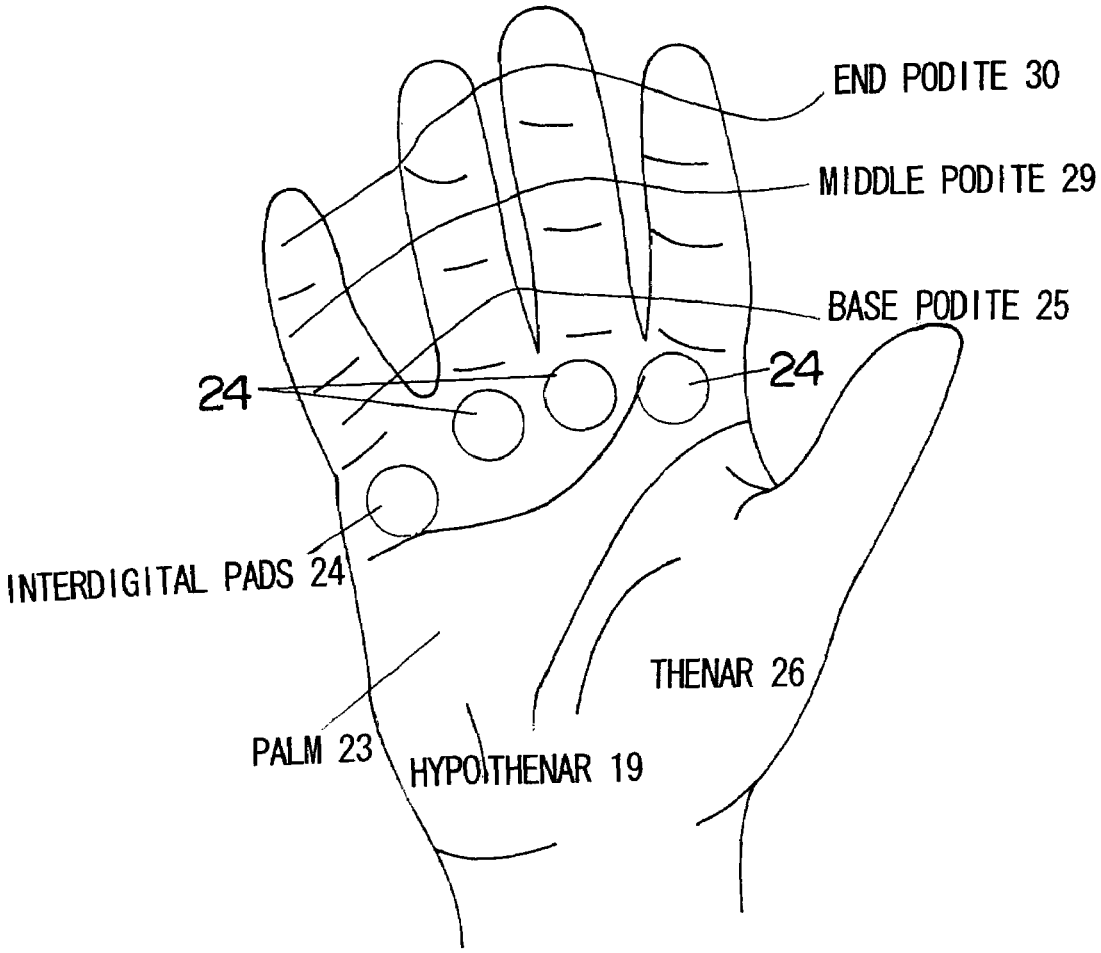
FIG. 8 is an explanatory view of the respective regions of the hand.

FIG. 8 shows names of respective regions of the hand. The curvature of the convex curve 21 in the shape of the substantially ovoid-shaped cross section on the back side of the main body 2 is set such that the convex curve 21 on the back side fits a concave curved plane on the surface of a palm 23, which is formed when it holds the shaver 1. Thereby, no gaps are produced between the main body 2 and the palm 23, making it possible to secure contact area between the main body 2 and the palm 23. As a result, as compared with shavers having conventional shapes, the holding force is increased, thus it is possible to secure stability when gripping the shaver 1. Regarding securing contact area of the main body 2 with interdigital pads 24, base podites 25 and the thenar 26 of the hand, it is possible to secure the contact area of the main body 2 with these regions by so forming the shape of the plan cross section of the main body 2 as to have a shape as shown in FIG. 7, whereby both ends of the convex curve 21 on the back side and the smooth convex curve 22 on the front side fit the interdigital pads 24, the base podites 25 and the thenar 26 of the hand.

Figure 9:
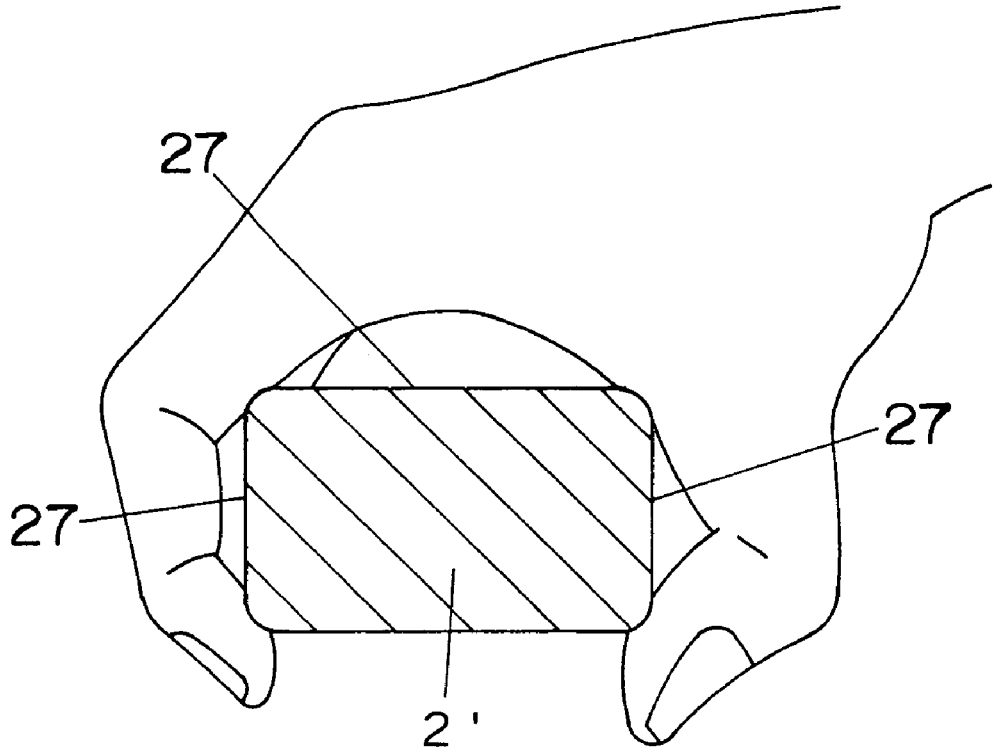
FIG. 9 is a schematic view showing a state where a shaver with a main body having a rectangular cross sectional shape is held.

It is assumed that the shape of the plan cross section of the main body 2 is, for example, a substantially rectangular shape as shown in FIG. 9. When the hand grips and holds a main body 2', it is difficult to have a good fit because respective surfaces 27 of the main body 2' are flat, so that it is difficult to secure enough contact area between the shaver and the hand. In contrast, by forming the shape of the plan cross section of the main body 2 to have a substantially ovoid shape as described above, it fits the palm 23, the interdigital pads 24, the base podites 25 and the thenar 26 of the hand, so that enough contact area between the shaver and these respective regions can be secured.

Now, referring to FIG. 7, it is preferred that the ratio of the length of the short axis to that of the long axis in the shape of the substantially ovoid-shaped plan cross section as described above be short axis:long axis≈1:1.5 in the vicinity of the position of the middle finger when holding the main body 2. In FIG. 7, M1 designates the size of the long axis, while M2 designates the size of the short axis. Such configuration makes it possible to make an optimum size ratio for maximizing the contact area between the main body 2 and the hand, and to secure the grip stability with increased holding force.

Besides, as shown in FIG. 1, the width of the main body 2 in the X-direction becomes gradually narrower as it approaches from the head portion 3 to the neck portion 2*a* at the substantially center portion, and has a minimum value once at the neck portion 2*a*. The width of the main body 2 in the X-direction becomes gradually wider once as it goes further downward from the neck portion 2*a* at the substantially center portion, and has a maximum value at a middle portion between the neck portion 2*a* of the substantially center portion and the lower end portion, after which it turns decreasing, and has a minimum width at the lower end portion. In other words, the front shape of the main body 2 is torso-shaped or substantially gourd-shaped. When the shaver 1 is held, concave curves 28 at both ends of the neck portion 2*a* at the substantially center portion in the Z-direction fit the portion 18 between the index finger and the thumb as shown in FIG. 6 as well as middle podites 29, end podites 30 and the like of the index finger and the middle finger, so that the main body 2 can be stably held.

As described in the foregoing, the shaver 1 in accordance with the first embodiment has a front shape which is torso-shaped, a side shape which is substantially S-shaped, and a cross sectional shape which is substantially ovoid-shaped at the grip portion that is the portion to hold the main body 2. Accordingly, when the main body 2 is gripped and held by the hand, no gaps are produced between the palm 23 and the main body 2, increasing its contact area with the part 18 between the index finger and the thumb, the hypothenar 19, the interdigital pads 24, the base podites 25 and the thenar 26 as well as with the middle podites 29 and the end podites 30 of the index finger and the middle finger, and thereby whereby the holding force increases.

Second Embodiment

Figure 10:
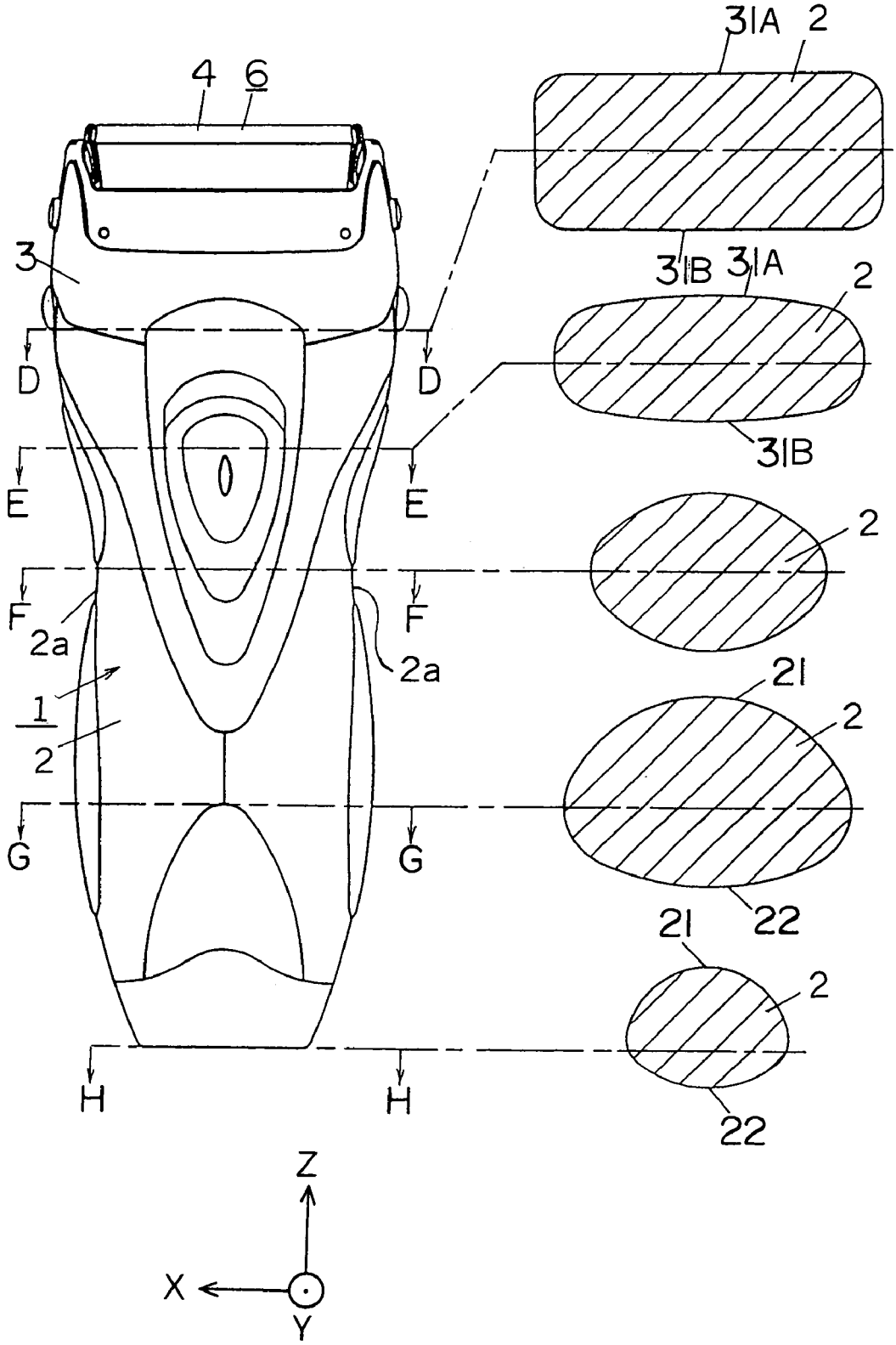
FIG. 10 is a view showing a relationship between a front shape and cross sectional shapes of respective portions of a shaver in accordance with second embodiment of the present invention.
Figure 11:
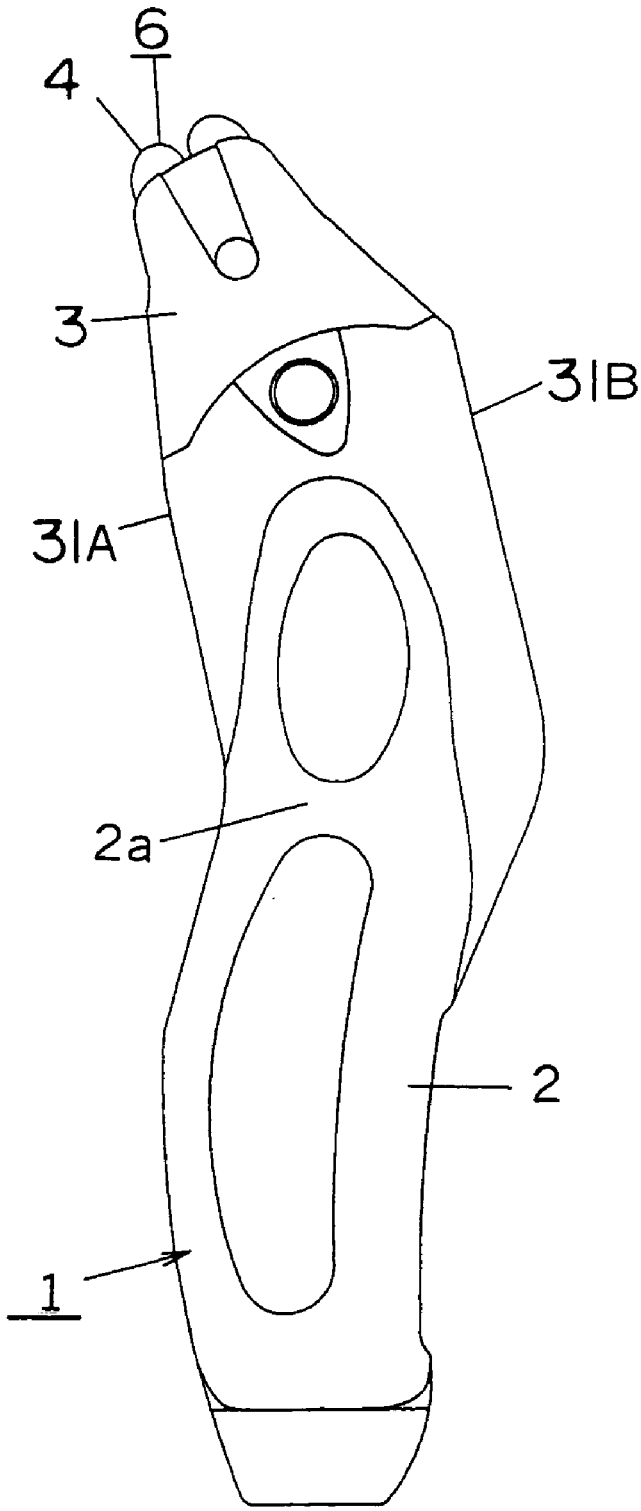
FIG. 11 is a side view of the shaver in accordance with the second embodiment as shown in FIG. 10.

A second embodiment of the present invention will be described with reference to the drawings. FIG. 10 is a view showing the relationship between respective positions, in the Z-direction, of a shaver 1 in accordance with the second embodiment and their cross sectional shapes. In FIG. 10, the left one shows a front view of the shaver 1, while the right ones show shapes of D-D cross section, E-E cross section, F-F cross section, G-G cross section and H-H cross section. FIG. 11 is a side view of the shaver 1.

As can be seen from FIG. 10, the D-D cross section in the vicinity of an upper end portion of a main body 2 and at a head portion 3 has a substantially rectangular shape which is flat on the front part and the back part. The E-E cross section at a middle portion between the vicinity of the upper end portion and a neck portion 2*a* of the main body 2 has a substantially pill shape which is substantially flat (of curved plane having a large curvature) on the front part and the back part. The F-F cross section at the neck portion 2*a* at a substantially center portion of the main body 2 has a substantially elliptical shape which has approximately the same curvature on the front part and the back part. Both the G-G cross section, at a middle portion between the neck portion 2*a* at the substantially center portion and a lower end portion of the main body 2, and the H-H cross section at the lower end of the main body 2 have substantially ovoid shapes, respectively, having a larger curvature on the back side than the curvature on the front side.

As can be seen from FIG. 10 and FIG. 11, the shaver 1 in accordance with the second embodiment is formed such that an upper back part 31A and an upper front part 31B of the main body 2 from the vicinity of the upper end portion of the main body 2 to the head portion 3 are made flatter, and that the shape of the cross section is gently changed to gradually become a substantially ovoid shape as it goes downward in the Z-direction.

Figure 12:
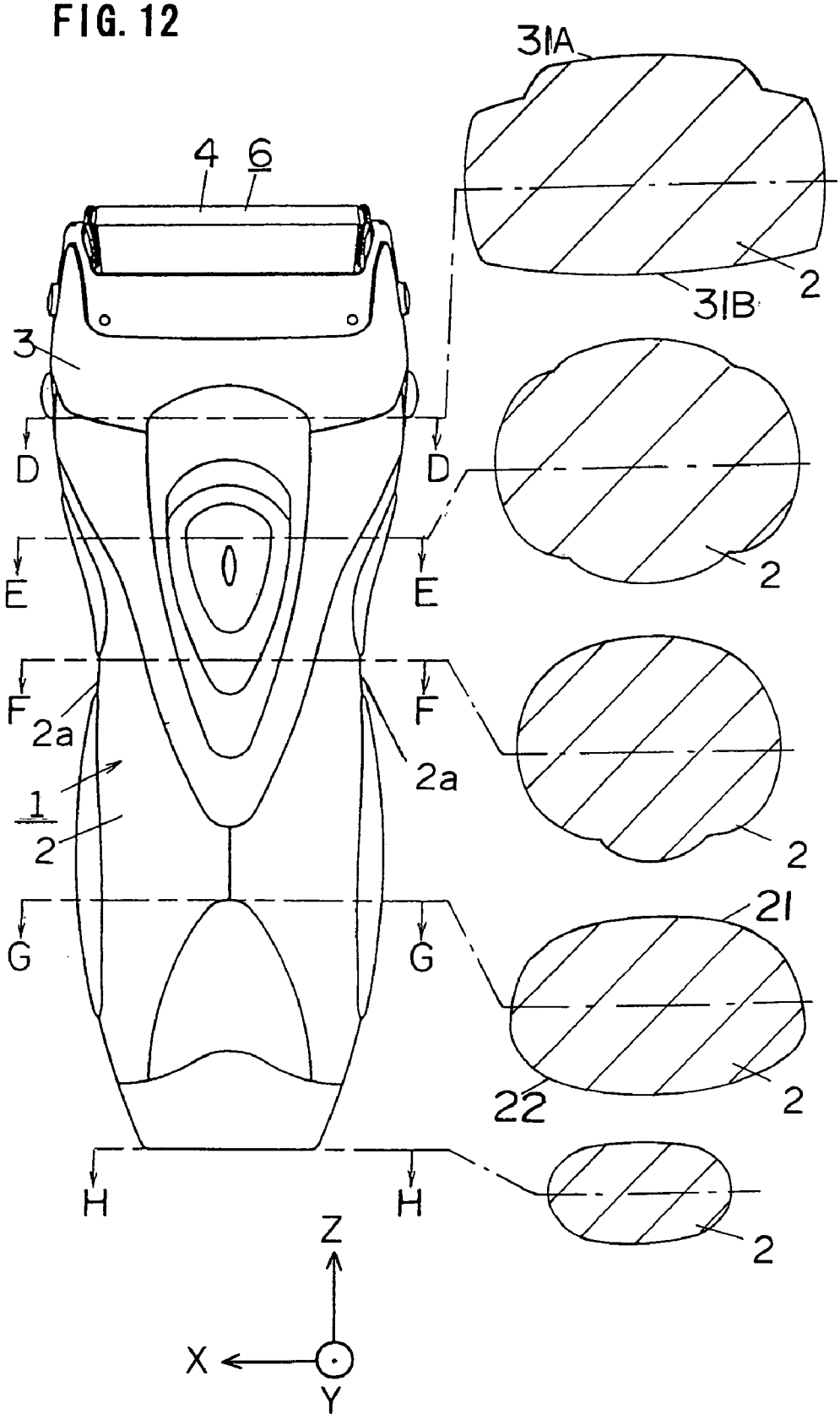
FIG. 12 is a view showing a relationship between a front shape and cross sectional shapes of respective portions of a modified example of the shaver in accordance with second embodiment of the present invention.
Figures 13A, 13B, 13C, 13D:
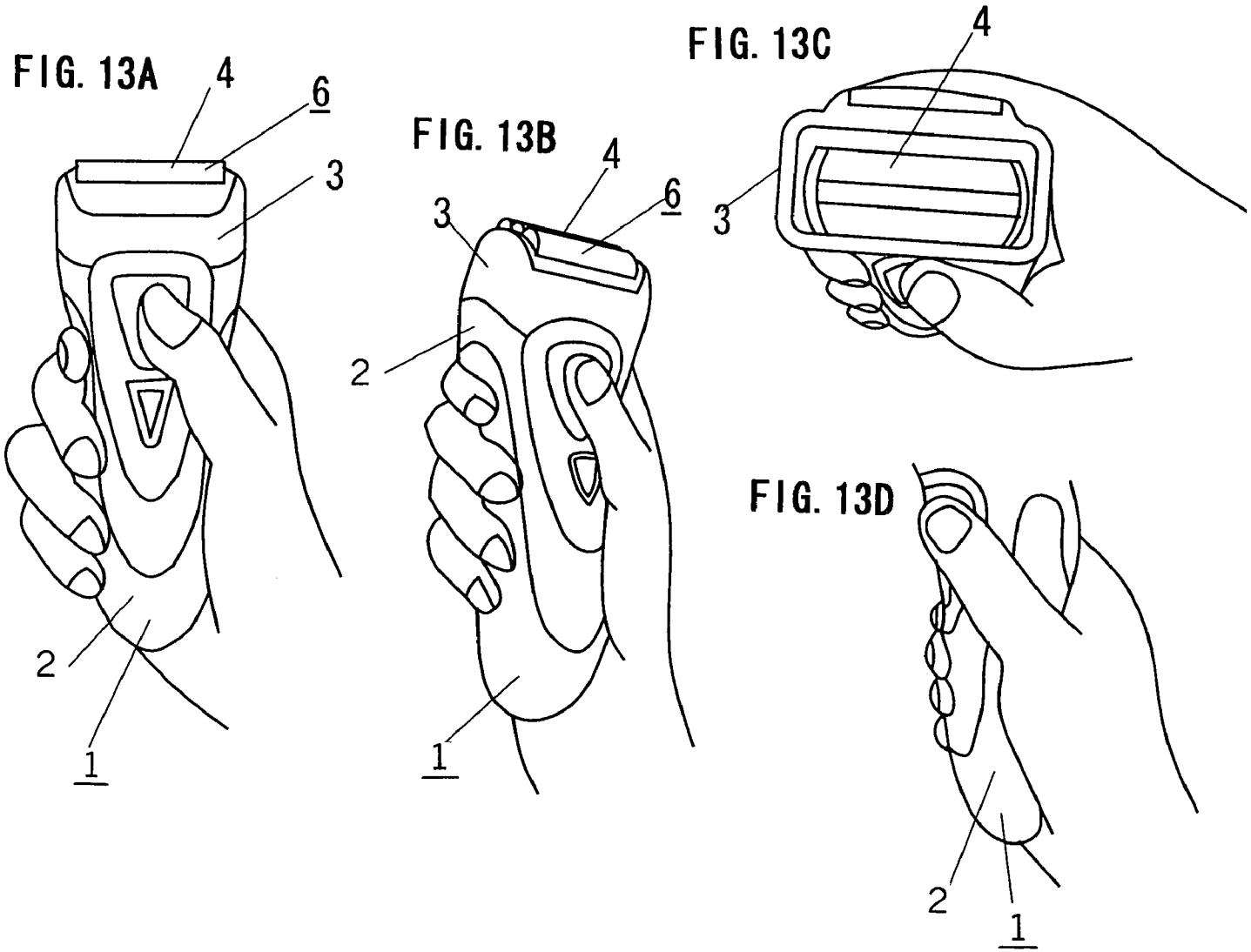
FIG. 13A, FIG. 13B, FIG. 13C and FIG. 13D are perspective views, respectively, showing states of gripping and holding the shaver in accordance with the second embodiment.
Figures 14A, 14B, 14C, 14D:
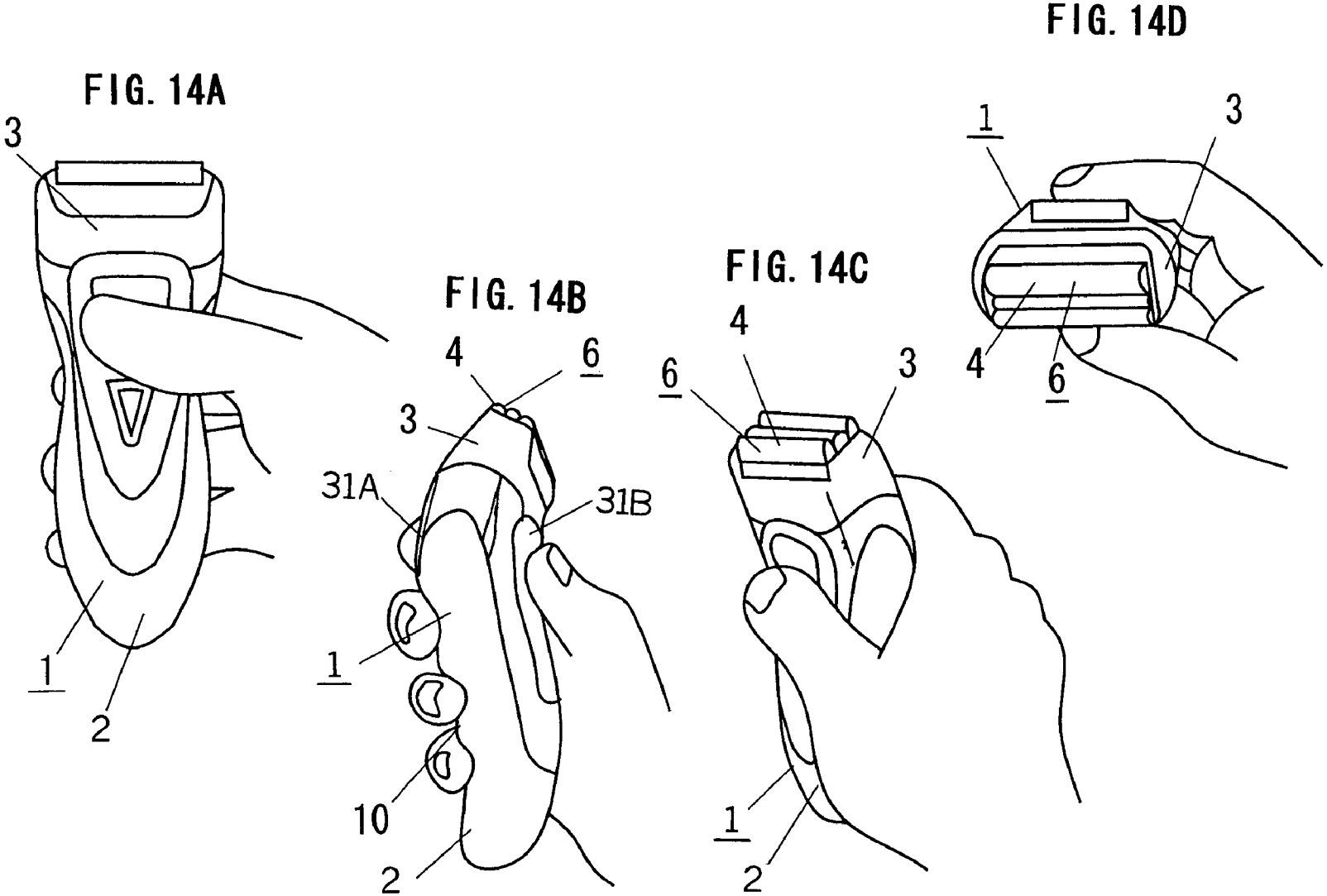
FIG. 14A, FIG. 14B, FIG. 14C and FIG. 14D are perspective views, respectively, explaining pinching and holding the shaver in accordance with the second embodiment.

A modified example of the shaver 1 in accordance with the second embodiment is shown in FIG. 12. In FIG. 12, the left one shows a front view of the shaver 1, while the right ones show shapes of D-D cross section, E-E cross section, F-F cross section, G-G cross section and H-H cross section.

As can be seen from FIG. 12, the D-D cross section in the vicinity of an upper end portion of a main body 2 and at a head portion 3 has a shape such that the front part is substantially flat (curved plane having a very large curvature), and the back part is stepped and substantially flat. The E-E cross section at a middle portion between the vicinity of the upper end portion and a neck portion 2*a* of the main body 2 has a substantially circular shape at a center portion, and further has stepped and substantially elliptical curved planes in the vicinity of both ends in the X-direction, wherein the front part and the back part are substantially symmetric to each other with respect to the center line. The F-F cross section at the neck portion 2*a* at a substantially center portion of the main body 2 has, on the front part, a substantially arc shape at a center portion as well as stepped and substantially parabolic curved planes in the vicinity of both ends in the X-direction, and further has, on the back part, a substantially elliptical curve. The G-G cross section at a middle portion between the neck portion 2*a* at a substantially center portion and a lower end portion of the main body 2 has a substantially ovoid shape having a larger curvature on the back side than the curvature on the front side. The H-H cross section at the lower end of the main body 2 has a substantially pill shape which is substantially flat (of curved plane having a large curvature) on the front part and the back part.

In the modified example as shown in FIG. 12, it is also formed such that an upper back part 31A and an upper front part 31B of the main body 2 from the vicinity of the upper end portion of the main body 2 to the head portion 3 are made flatter, and that the shape of the cross section is gently changed to gradually become a substantially ovoid shape as it goes downward in the Z-direction.

As for the shaver 1 in accordance with the second embodiment, there are cases where it is held by gripping and holding as shown in FIG. 13A to FIG. 13D, and where it is held by pinching and holding as shown in FIG. 14A to FIG. 14D. In the case where it is held by gripping and holding as shown in FIG. 13A to FIG. 13D, similar effects as in the case of the above first embodiment can be obtained by gripping and holding a portion at the lower part of the main body 2, as a grip, where the cross section is substantially ovoid-shaped.

On the other hand, in the case where it is held by pinching and holding as shown in FIG. 14A to FIG. 14D, the upper back part 31A and a back concave curved portion 10 of the main body 2 are held by the four fingers other than the thumb, while the upper front part 31B is held by the thumb. In the second embodiment, since each of the upper back part 31A and the upper front part 31B is made substantially flat, it becomes easier for a finger in contact with the flat upper back part 31A to adjust the finger pressure. Accordingly, the angle of the shaver 1 can be finely varied by finely adjusting the angles of the finger joints, so that it becomes easier to finely adjust the contact angle of the razor 6 against the irregularities of the face.

Third Embodiment

Subsequently, a third embodiment of the present invention will be described with reference to FIG. 15 to FIG. 17. In accordance with the third embodiment, in order to increase frictional resistance and make it hard to slip when a main body 2 of a shaver 1 is held by hand, an anti slip portion 8 for preventing the slip is provided on the main body.

Figure 15:
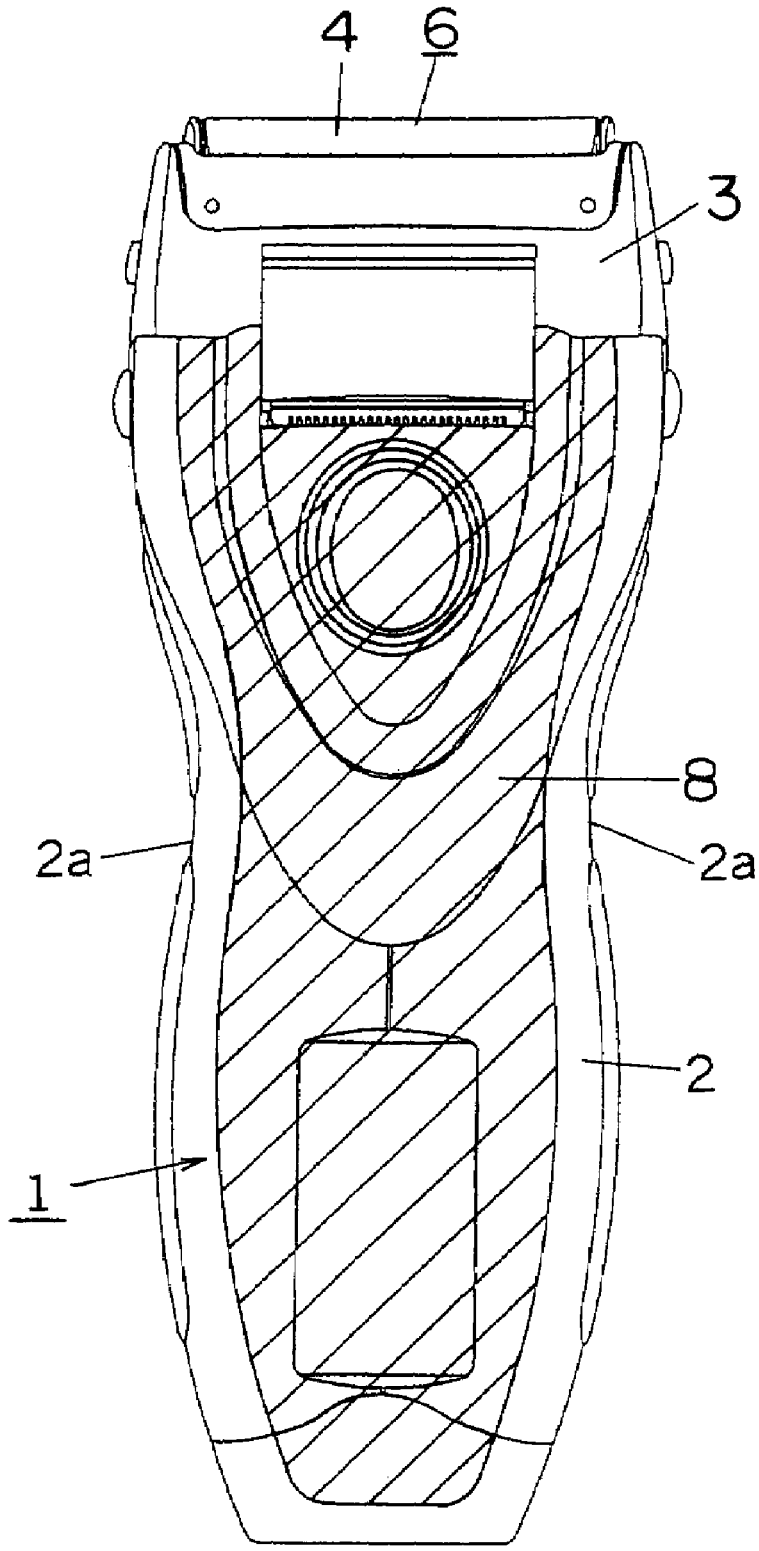
FIG. 15 is a rear view showing an example in which an anti slip portion is provided on a back portion of the main body of a shaver in accordance with a third embodiment of the present invention.

FIG. 15 is a rear view of the shaver 1 in accordance with the third embodiment. A portion shown by hatching on the back of the main body 2 shown in FIG. 15 is the anti slip portion 8. For example, in the case where the shaver 1 is held as shown in FIG. 13A to FIG. 13D, the frictional resistance of the main body 2 against the part 18, which is between the index finger and the thumb, and against the hypothenar 19 as shown in FIG. 6 increases, so that it is possible to stably hold the main body 2. It is, thus, not necessary to strongly hold the main body 2 to prevent it from slipping; and it is possible to shave without getting tired, since it is possible to stably hold it. Furthermore, since the main body 2 becomes hard to slip, it becomes easier to apply a force to press the outer blades 4 against the skin, it is possible to easily perform deep shaving. In addition, fit feeling to the palm can be obtained, so that it is comfortable and improving feeling in use.

Figure 16:
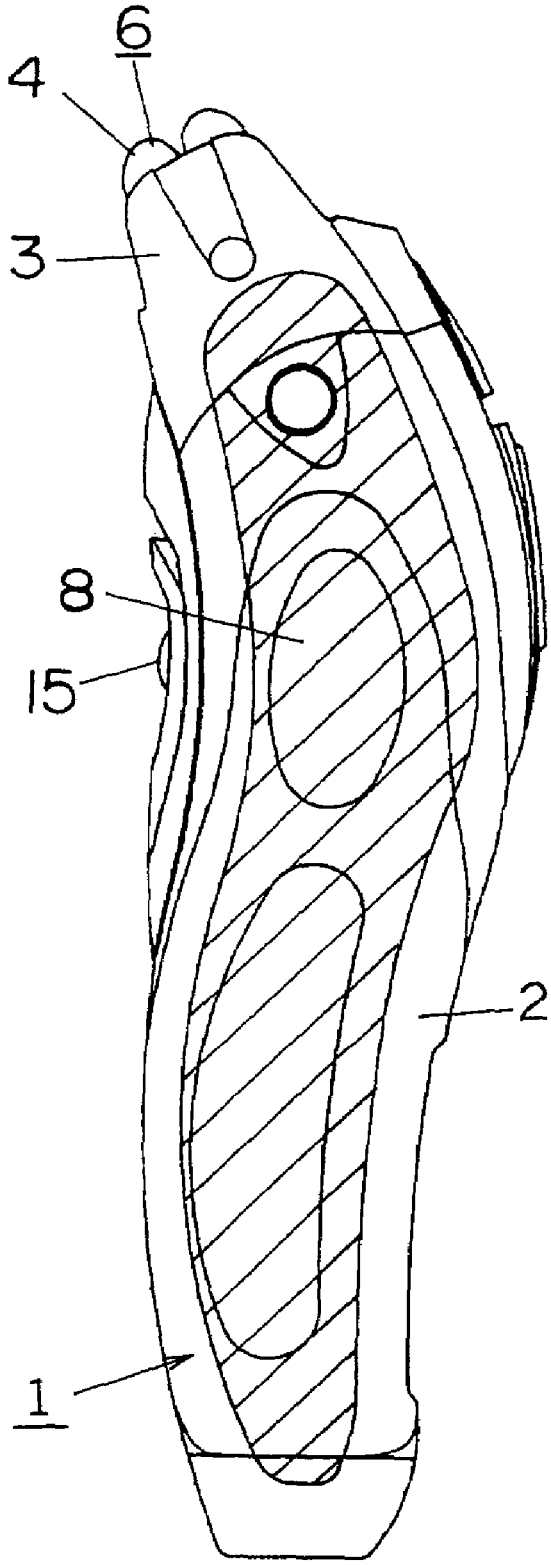
FIG. 16 is a side view showing an example in which an anti slip portion is provided on a side portion of the main body of the shaver in accordance with the third embodiment of the present invention.

FIG. 16 is a side view showing an example in which an anti slip portion 8 is provided at a portion shown by hatching on a side of the main body 2 as well. By thus providing the anti slip portion 8 on the side of the main body 2, it is possible to improve the holdability from the thenar 26, the interdigital pads 24 and the end podites 30 to the middle podites 29. As a result, when picking up the shaver 1, it is hard to slip and easy to hold up. Further, it reduces the danger of dropping the shaver 1. In addition, due to the existence of this anti slip portion 8, the shaver 1 becomes easy to operate, and further the shaver 1 becomes hard to slip when finely adjusting the angle of the head portion 3 at the time of using the shaver 1, so that the shaving can be performed more comfortably.

Figure 17:
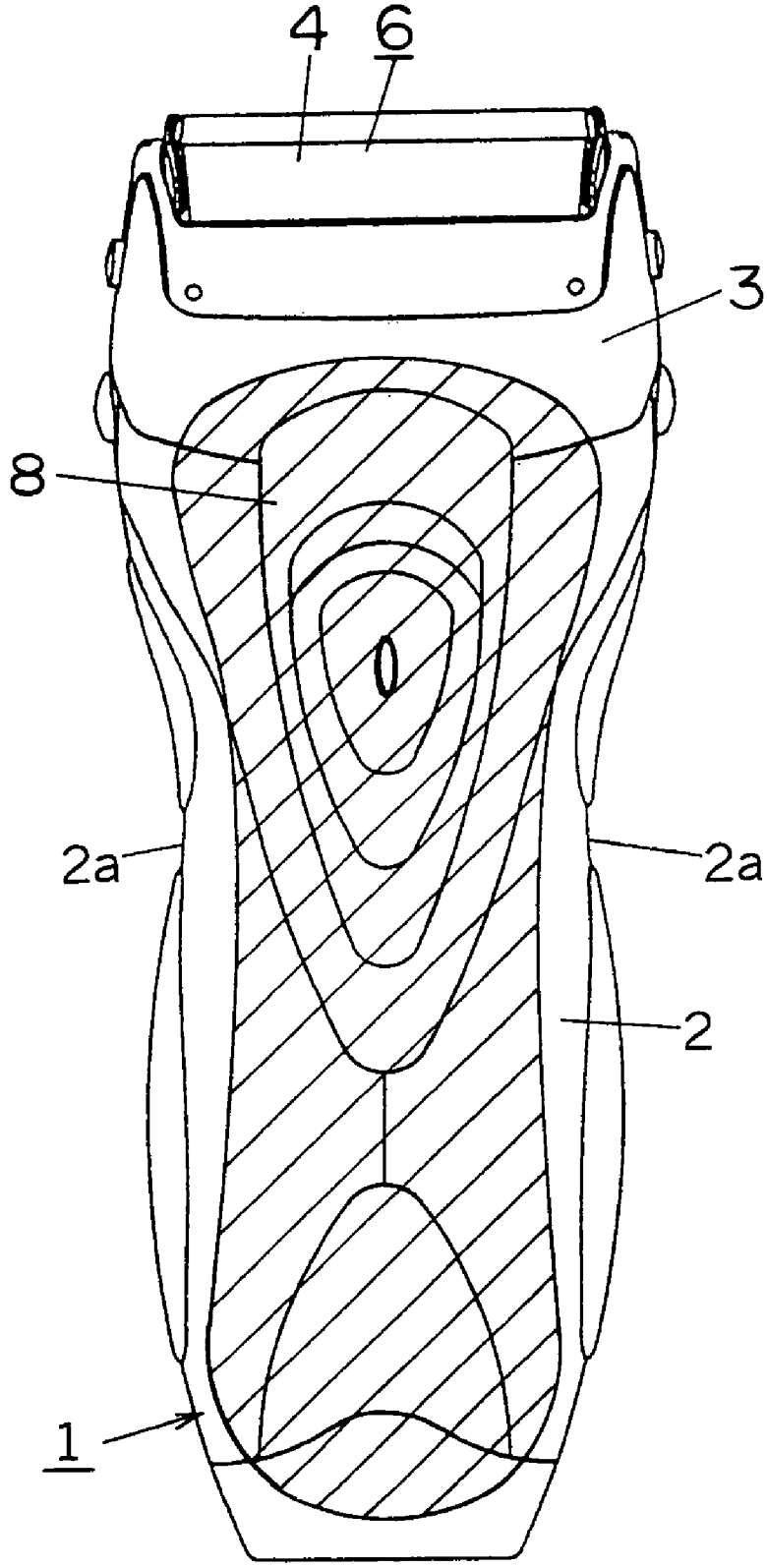
FIG. 17 is a front view showing an example in which an anti slip portion is provided on a front portion of the main body of the shaver in accordance with the third embodiment of the present invention.

FIG. 17 is a front view showing an example in which an anti slip portion 8 is also provided on the front of the main body. A portion shown by hatching in FIG. 17 is the anti slip portion 8. By thus providing the anti slip portion 8 on the front of the main body 2, it is possible to increase the frictional resistance of the main body 2 against the thumb and the end podites, so that it is possible to improve the easiness of holding the shaver 1 for various ways of holding the shaver 1.

For example, when gripping and holding it by the thumb put on the front together with the remaining four fingers as shown in FIG. 14A to FIG. 14D, the thumb and the index finger hold an upper part of the main body 2, and the remaining three fingers contact along and hold the main body 2 at the index finger side. This means that the thumb and the remaining four fingers pinch and hold the main body 2 therebetween. At such time, owing to the anti slip portion 8 on the front, the thumb portion which is difficult to hold becomes hard to slip, so that the shaver 1 becomes easy to be held, whereby the operability is improved. Thus, it becomes easy to adjust the contact angle of the razor 6 of the shaver 1 against and adapted to the curved surface of the face, so that it is possible to stably press the razor 6 against the skin. Further, it leaves no unshaved area, and enables deep shaving, making it possible to shave in a short time. In addition, the effect of slip prevention due to the anti slip portion 8 can be further enhanced by providing a combination of the anti slip portions 8 on the back, the side and the front of the main body 2.

In either one of the above modes, the frictional force can be increased by forming the surface of each anti slip portion 8 to have irregularities such as divots and ribs, making it possible to enhance the effect of slip prevention due to the slip property portion 8 (sic: correctly anti slip portion 8).

Since a member constituting the anti slip portion 8 is made of an elastic material, the contact area with the hand increases because of the deformation of the elastic material, thereby it is possible further to enhance the effect of slip prevention due to the anti slip portion 8. Owing to the elastic material, the anti slip portion 8 is flexible, and deforms by finger pressure. Accordingly, the anti slip portion 8 fits the shapes of the fingers to make it possible to enhance the effect of slip prevention, and moreover can provide a grip adaptable to various users. This leads to that it is possible to enhance effects of functions in shaving such as deep shaving, easiness to target the beard and easiness to handle the shaver 1, and moreover that it also has effects of sensually satisfying users such as comfort in holding and easiness to hold it. The elastic material can be of rubber material, sponge or the like as well as hollow elastic material further having gas, liquid or the like sealed inside.

Fourth Embodiment

Figure 18:
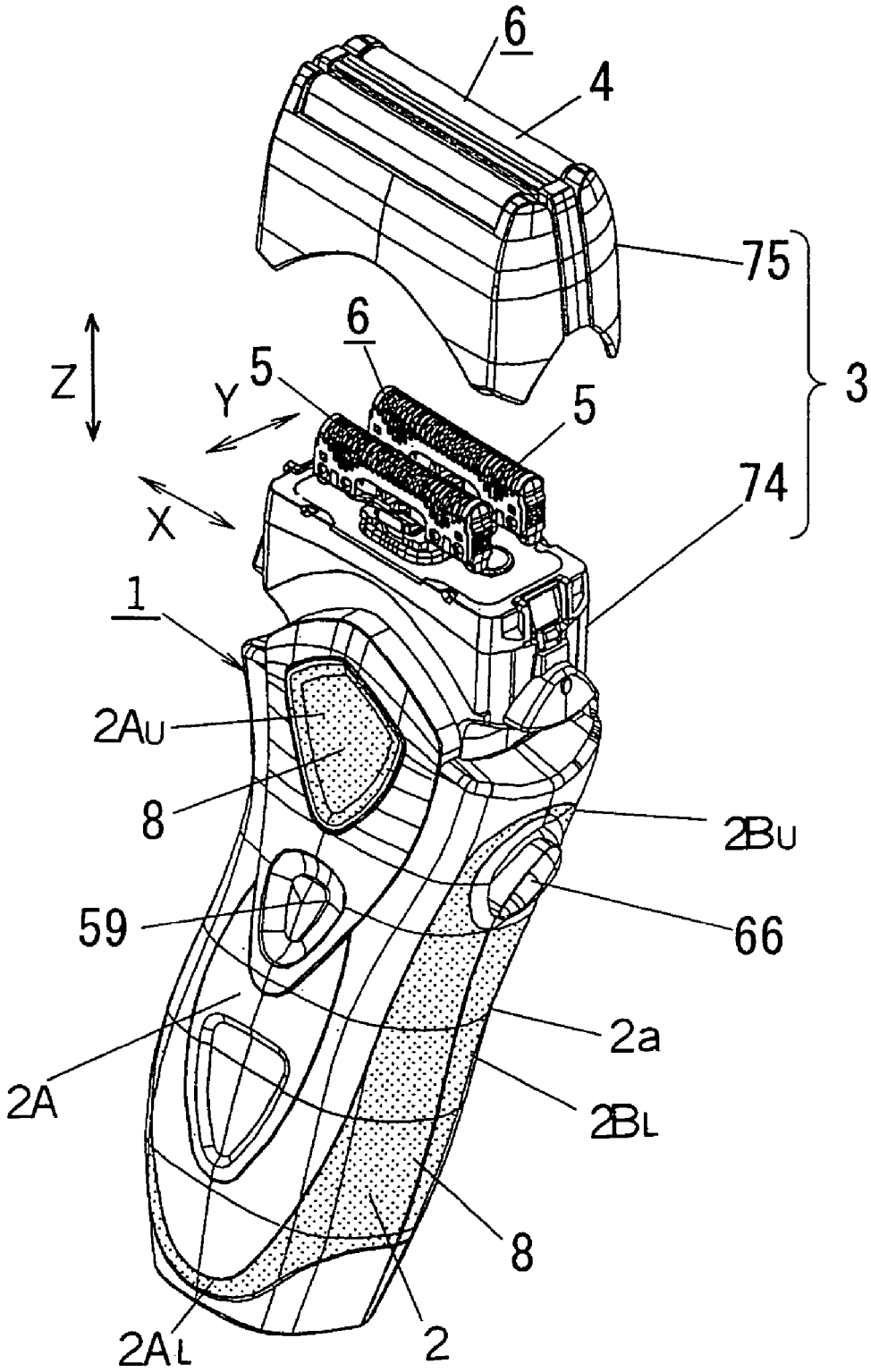
FIG. 18 is a perspective view showing the shape of a shaver in accordance with a fourth embodiment of the present invention.
Figure 19:
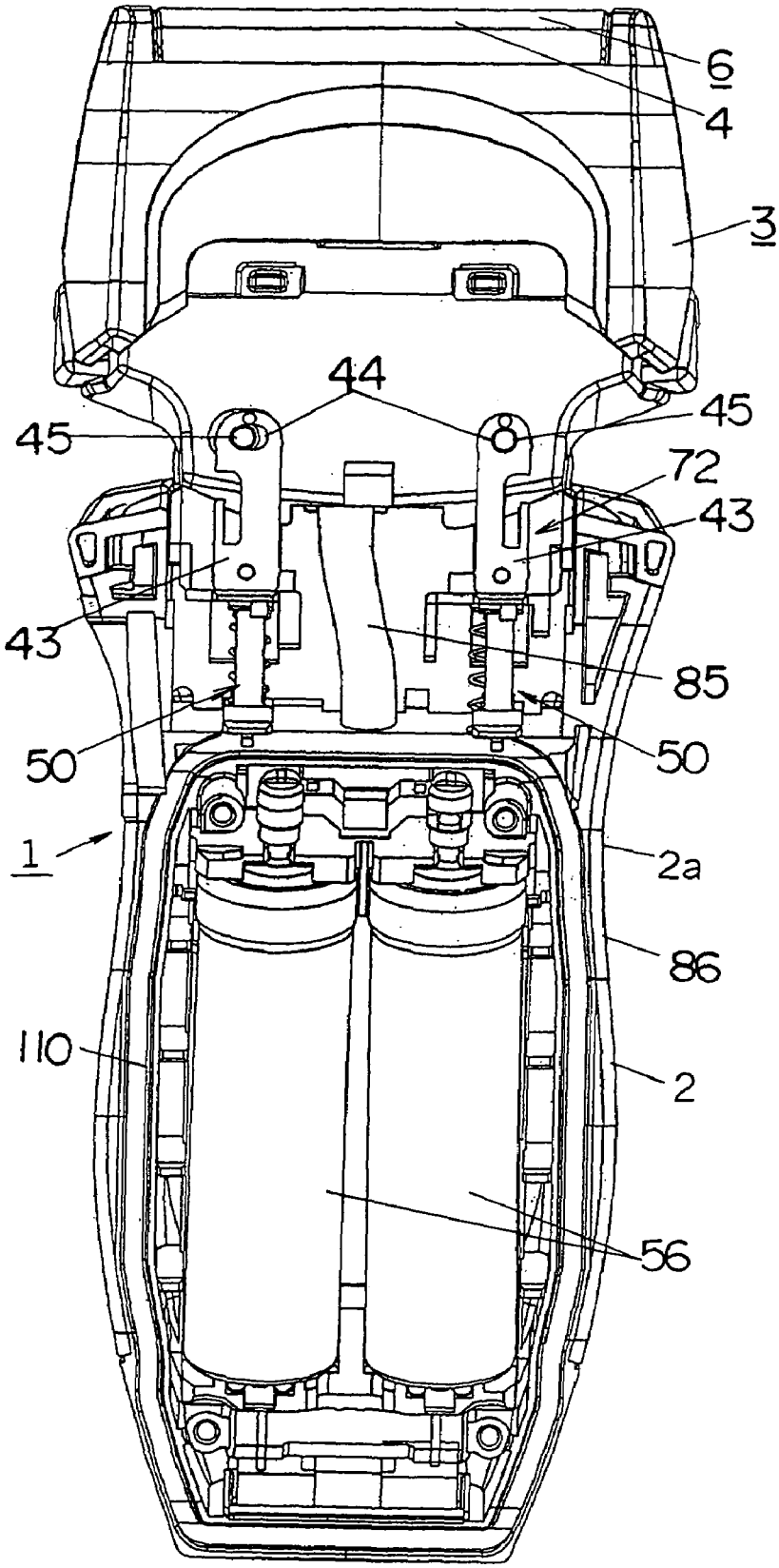
FIG. 19 is a front cross sectional view showing an inner structure of the shaver in accordance with the fourth embodiment of the present invention.
Figure 20A:
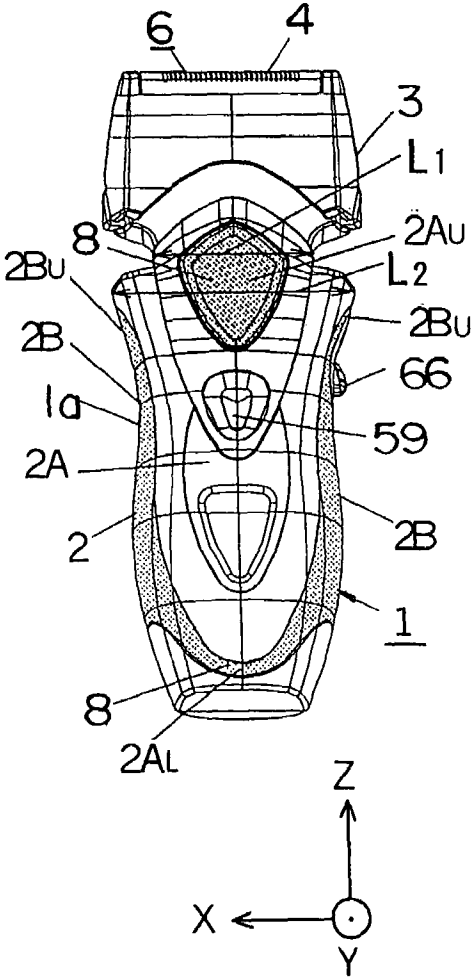
FIG. 20A, FIG. 20B and FIG. 20C are a front view, a side view and a rear view, respectively, of the shaver in accordance with the fourth embodiment of the present invention.
Figure 20B:
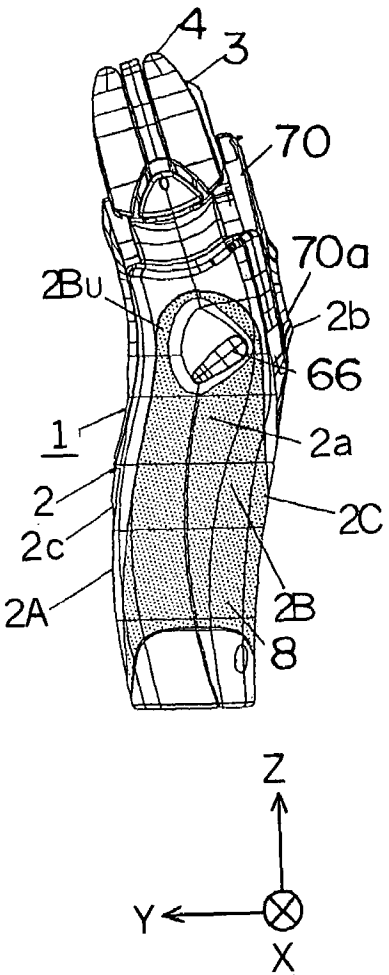
Figure 20C:
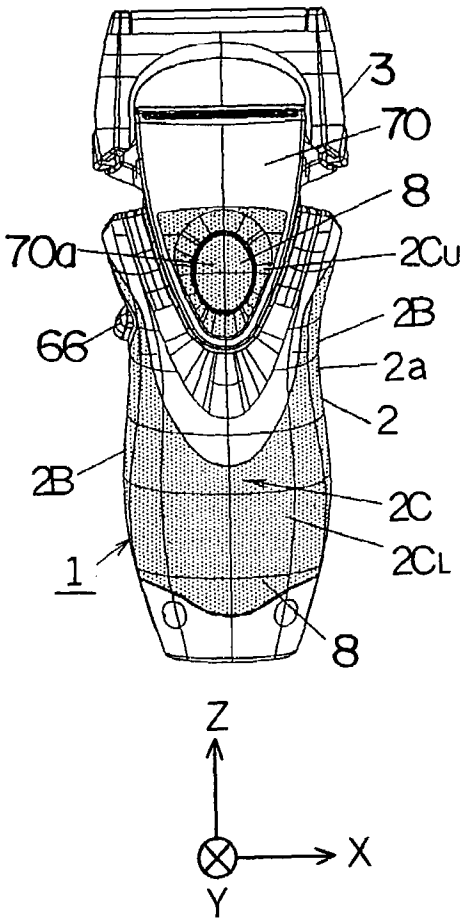

Subsequently, a fourth embodiment of the present invention will be described with reference to FIG. 18 to FIG. 27. Note that the equivalent elements in the above respective embodiments are designated by the same reference numerals, while different elements are designated by different reference numerals. FIG. 18 is a perspective view showing an appearance and configuration of a shaver 1 with an outer blade block 75 having been removed. FIG. 19 is a cross sectional view showing an inner configuration of the shaver 1. FIG. 20A, FIG. 20B and FIG. 20C are a front view, a side view and a rear view of the shaver 1, respectively.

As shown in FIG. 18, in the shaver 1 in accordance with the fourth embodiment as well, a head portion 3 comprising, at an upper end portion thereof, a razor 6 having outer blades 4 and inner blades 5 is provided on an upper end of a main body 2. As shown in FIG. 19, a head support block 72 to support the head portion 3 is provided in the vicinity of the upper end of the inside of the main body 2.

As shown in FIG. 18, FIG. 20A and FIG. 20C, the shape of the entire front cross section of the shaver 1 is a torso shape provided with a neck portion 2*b* (sic: correctly 2*a*) having a narrowed width in the X-direction at a substantially center portion in the Z-direction. Further, as shown in FIG. 20B, the shape of the entire side cross section of the shaver 1 is a substantially S-shape. Accordingly, in the shaver 1 in accordance with the fourth embodiment as well as in the shaver 1 in accordance with each of the above embodiments, the torso-shaped neck portion 2*a* is positioned between a vertex 2*b* of an upper bent portion (sic) and a vertex 2*c* of a lower bent portion (sic) on the substantially S-shaped side of the shaver 1.

Thus, in the fourth embodiment as well, the entire shape of the shaver 1 has the torso shape as seen from the front and the substantially S-shape as seen from the side, so that it has similar functions and effects as in the shaver 1 in accordance with each of the above embodiments. Description in this respect is omitted, because it would be a repetition of the description already made in each of the embodiments.

Figure 21A:
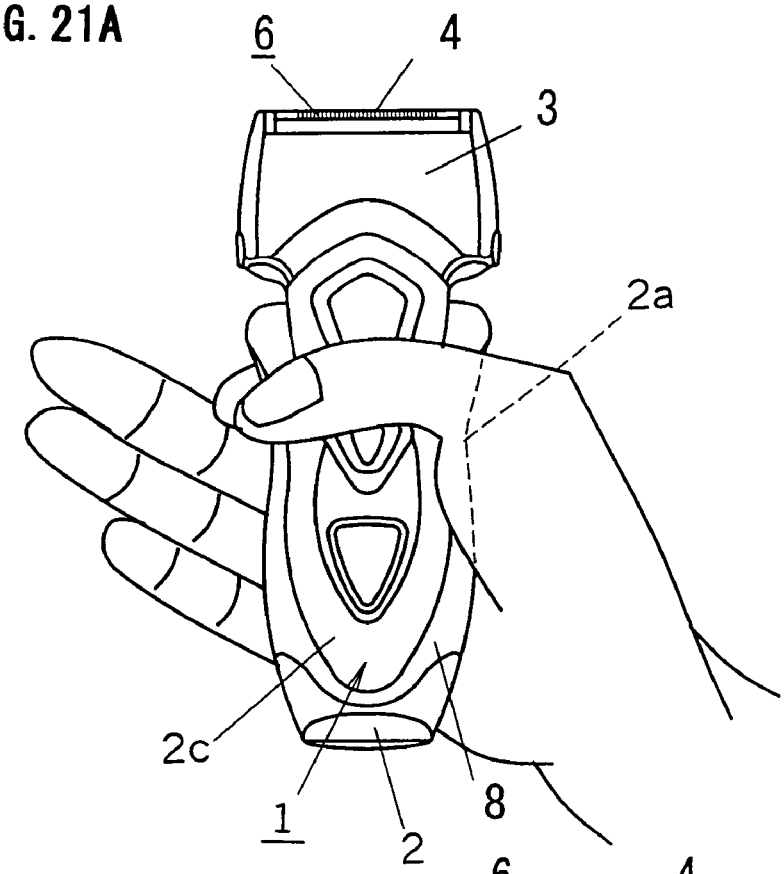
FIG. 21A and FIG. 21B are front views, respectively, of the shaver in accordance with the fourth embodiment, showing a process to grip and hold it.
Figure 21B:
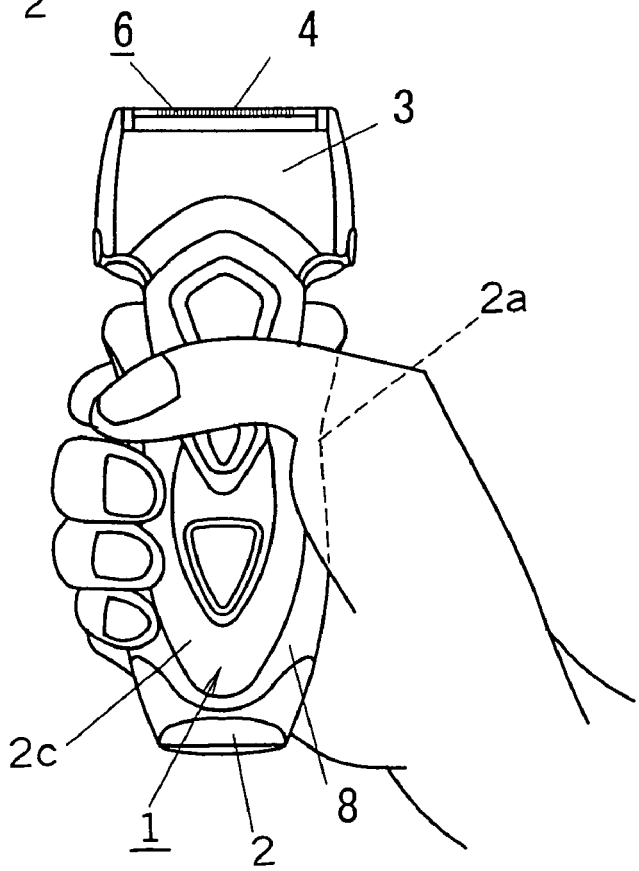

Similarly as in each of the above embodiments, it is possible to finely adjust the angle of the razor 6 against the skin when gripping and holding the shaver 1. FIG. 21A and FIG. 21B show the gripping and holding of the shaver 1 in accordance with the fourth embodiment. FIG. 21A corresponds to FIG. 5A in the first embodiment, while FIG. 21B corresponds to FIG. 5B. For the same reason as in the case of the first embodiment as shown in FIG. 5A and FIG. 5B, it is possible to easily perform fine adjustment of the razor 6 against the skin by pivoting the shaver 1 slightly in the left and right direction (X-direction) or the forward and backward direction (Y-direction), using the part gripped by the thumb and the index finger as a fulcrum, in a manner that the middle finger, the ring finger, the little finger and the like contacting along the torso-shaped neck portion 2*a*, as seen from the front, and the vicinity of the lower bent portion 2*c* of the substantially S-shape, as seen from the side, press the neck portion 2*a* and the vicinity of the lower bent portion 2C (sic: correctly 2*c*) of the substantially S-shape which is convex to the front.

In the fourth embodiment as well, the shape of the front cross section of the shaver 1 is formed to be the torso shape in which the width of the neck portion 2*a* in the X-direction is narrowed at a substantially center portion in the Z-direction, and is narrower than the width of the head portion 3, and in which the width at the lower end portion of the main body 2 is minimum. The functions and effects in accordance with this configuration are similar as in the above first embodiment.

Subsequently, an anti slip mechanism of the main body 2 serving as a grip portion in accordance with the fourth embodiment will be described.

As shown by the dotted areas in FIG. 18, FIG. 20A, FIG. 20B and FIG. 20C, an anti slip portion 8 (for example, anti slip portion made of an elastic material having a high friction coefficient such as elastomer) is continuously provided on the main body 2 from the sides 2B to a lower half part $2C_L$ of the back 2C. In addition, this anti slip portion 8 is also provided on an upper half part $2A_U$ of the front 2A of the main body 2. The anti slip portion 8 on the sides 2B extends from a lower half part $2B_L$ to an upper half part $2B_U$ of the sides 2B. Furthermore, the anti slip portion 8 is also provided on the upper half part $2C_U$ of the back 2C of the main body 2. This anti slip portion 8 provided on the upper half part $2C_U$ of the back 2C serves simultaneously as a trimmer operation portion.

Hereupon, the anti slip portion 8 on the upper half part $2A_U$ of the front 2A of the main body 2 is provided at substantially the same height as the anti slip portion 8 on the upper half part $2C_U$ of the back 2C, so that the holding force of the thumb from the front 2A gets in balance with the holding force of the index finger and the middle finger from the back 2C. Furthermore, the anti slip portion 8 on the sides 2B of the main body 2 extends to the lower half part $2A_L$ of the front 2A, so that the anti slip portion 8 is continuously provided to wrap around the main body 2.

Figure 22A:
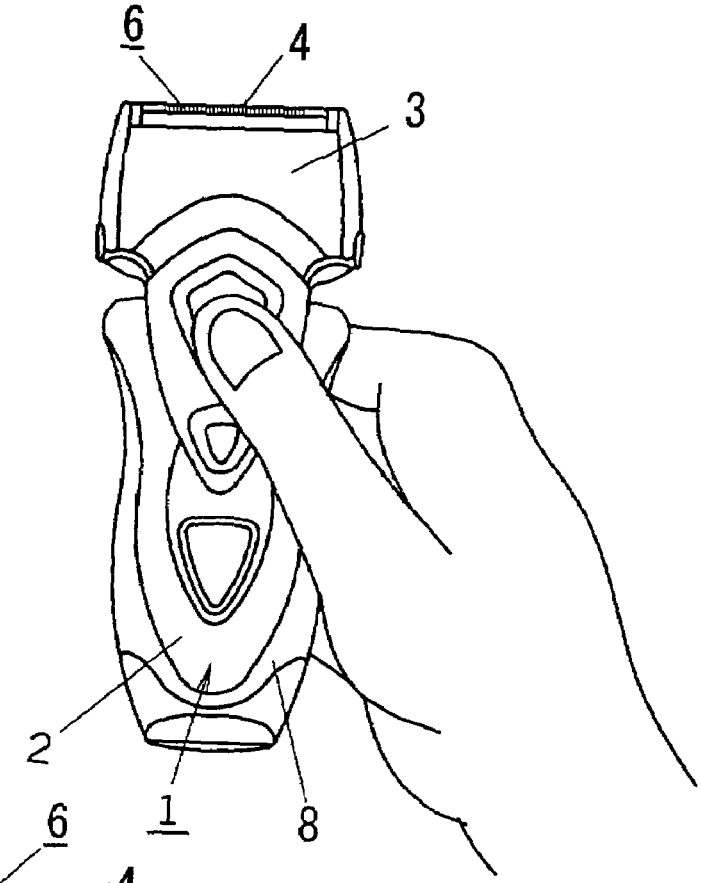
FIG. 22A and FIG. 22B are a front view and a perspective view, respectively, showing states of pinching and holding the shaver in accordance with the fourth embodiment.
Figure 22B:
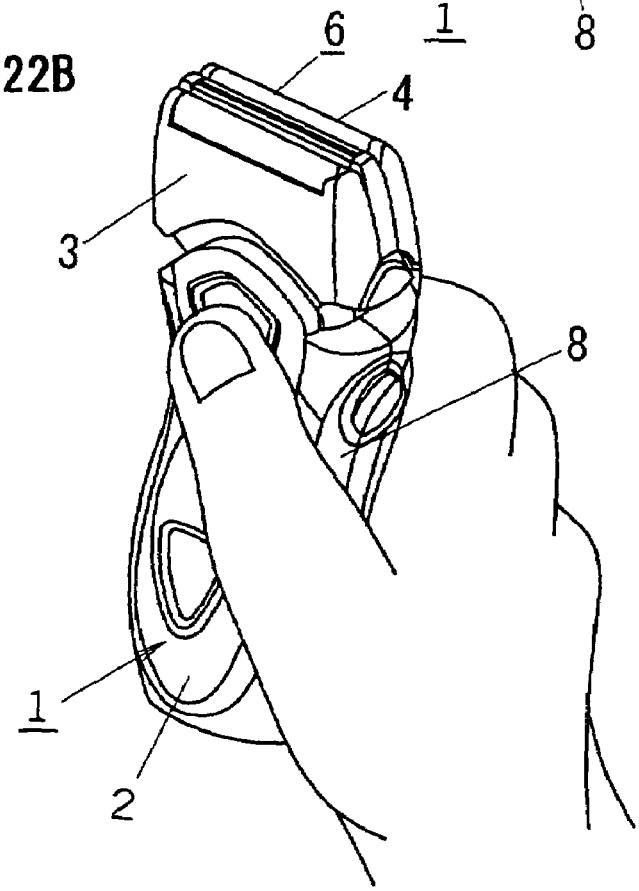
Figure 23A:
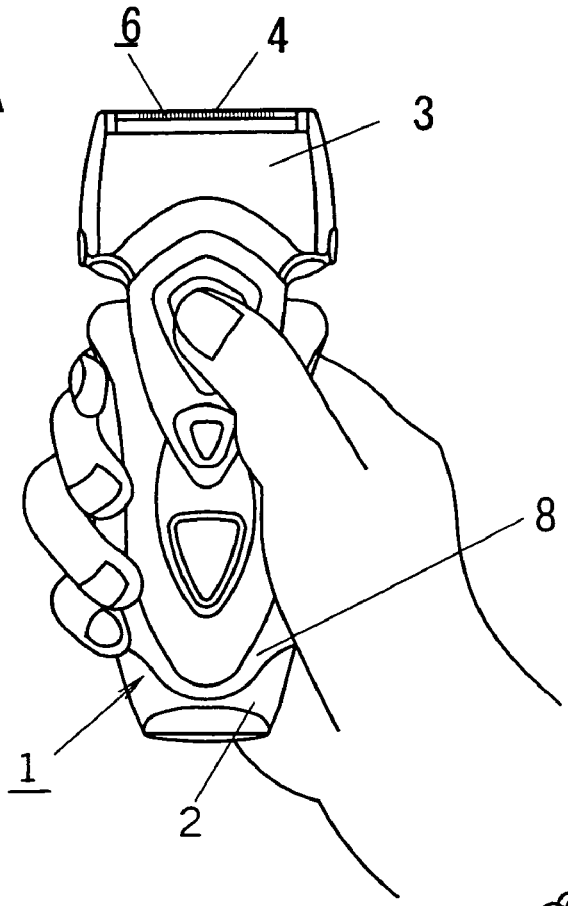
FIG. 23A and FIG. 23B are a front view and a perspective view, respectively, showing states of gripping and holding the shaver in accordance with the fourth embodiment.
Figure 23B:
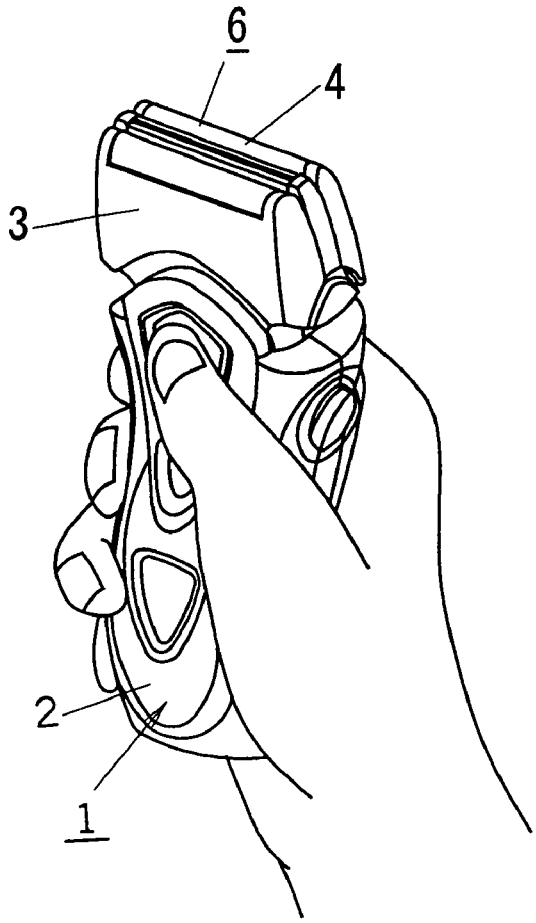

By continuously providing the anti slip portion 8, made of an elastomer (elastic material having a high friction coefficient), on the main body 2 from the sides 2B to the lower half part $2C_L$ of the back 2C in this way, it is possible that allow an interdigital pad 24, a base podite 25, a middle podite 29 and an end podite 30 of at least one of the index finger, the ring finger and the little finger as well as the hypothenar 19 and the thenar 26 to securely contact the anti slip portion 8 in either the case of "pinching and holding" as shown in FIG. 22A and FIG. 22B or the case of "gripping and holding" as shown in FIG. 23A and FIG. 23B, regardless of the size of the hand or subtle position slippage when holding it. Accordingly, the grippability (grip-holding performance) against the contact pressure from the side direction and the back direction increases. Furthermore, by providing the anti slip portion 8 made of an elastomer on the upper half part $2A_U$ of the front 2A of the main body 2, the grippability against the contact pressure from the front 2A increases, because the end podite of the thumb contacts the anti slip portion 8.

Furthermore, since the anti slip portion 8 on the sides 2B of the main body 2 extends to the upper half part $2B_U$ of the sides 2B, all the end podites 30 of the index finger, the middle finger, the ring finger and the little finger get in contact with this anti slip portion 8. In addition, since the anti slip portion 8 is also provided on the upper half part $2C_U$ of the back 2C of the main body 2, the base podite 25 and the middle podite 29 of the index finger or the middle finger gets in contact with this anti slip portion 8.

Accordingly, even if there are differences in the size of the hand and the way of holding of the user, the contact pressure is applied to the area where the anti slip portions 8 are provided, so that sufficient grippability at the front holding portion can be obtained. Thus, even in the case of holding the shaver 1 by the "pinching and holding" or the "gripping and holding", the grippability can be increased, making it possible to provide the shaver 1 which is hard to slip during use and has the main body 2 that is easy to use. As a result, when pressing the razor 6 against the skin, it is possible to shave with an optimum pressing force without being overpowered by the pressing force. In addition, it has an advantage that the razor 6 (head portion 3) contacts the skin at an optimum angle, so that the time to shave can be shortened.

Besides, as shown in FIG. 20B and FIG. 20C, the anti slip portion 8 provided on the upper half part $2C_U$ of the back 2C of the main body 2 serves simultaneously as a trimmer operation portion 70*a*. Specifically, a trimmer block 70 which will be described below is provided on the upper part of the back 2C of the main block portion 2. A lower part of the trimmer block 70 is made as the trimmer operation portion 70*a* to slide this trimmer block 70. An anti slip portion 8 is provided on this trimmer operation portion 70*a*. The trimmer operation portion 70*a* provided with this anti slip portion 8 is positioned in the vicinity of the upper bent portion 2*b* of the substantially S-shape on the substantially S-shaped side of the shaver 1. Since the trimmer operation portion 70*a* is positioned in the vicinity of the upper bent portion 2*b* of the substantially S-shape in such way, the trimmer operation portion 70*a* functions as a finger contact portion when hairline-shaving by a trimmer. When performing trimming operation, in the case of either the "gripping and holding" or the "pinching and holding", it is possible to stably to hold the shaver 1 at a position near the head portion 3 by holding it in such a manner as to position the thumb right on the back side of the upper bent portion 2*b* of the substantially S-shape of the shaver 1. According to the shaver 1 of the present embodiment, the trimmer operation portion 70*a* provided with the anti slip portion, which functions as a finger contact portion, contacts the thumb, so that up and down operation of the trimmer operation portion 70*a* can be easily performed by the thumb without slipping. Thus, not only the grippability but also the tripper operability increases.

As described in the foregoing, the anti slip portion 8 is provided on the upper part $2A_U$ of the front 2A of the main body 2 at a position where the thumb is put when holding the shaver 1. Further, in the trimmer block 70, the anti slip portion 8 is provided on the trimmer operation portion 70*a* (the upper part $2C_U$ of the back 2C) at substantially the same height as the anti slip portion 8 of the upper part $2A_U$ of the front 2A of the main body 2. Thereby, the holding force by the thumb from the front 2A of the main body 2 gets in balance with the holding force by the index finger and the middle finger from the back 2C. Accordingly, it becomes unnecessary to hold by all the five fingers, and the grippability becomes stable even if the shaver 1 is held only by the thumb, the index finger and the middle finger. Furthermore, the end podite of the thumb contacts with the anti slip portion 8 of the upper part $2A_U$ of the front 2A of the main body 2, while the base podite 25 and the middle podite 29 of the index finger contact with the anti slip portion 8 of the trimmer operation portion 70*a* of the trimmer block 70, respectively. Furthermore, the anti slip portion 8 on the sides 2B of the main body 2 extends to the lower half part $2A_L$ of the front 2A, so that the anti slip portion 8 is continuously provided to wrap around the main body 2. Accordingly, even when holding and using it with the front 2A and the back 2C of the main body 2 being reversed, the little finger or the ring finger contacts with the anti slip portion 8, so that enough grippability can be obtained. As a result, the configuration becomes such that the grippability to hold the shaver 1 increases, and it is harder to slip during use and easy to use.

In the fourth embodiment, the anti slip portion 8 is continuously provided to wrap around the main body 2, but it is not necessarily limited to this, and it is enough as long as it is provided on the main body 2 at least from the sides 2B to the lower half part $2C_L$ of the back 2C continuously as well as on the upper half part $2A_U$ of the front 2A.

Subsequently, the configuration of the shaver 1 in accordance with the fourth embodiment will be described with reference to FIG. 24 to FIG. 27.

Figure 26:
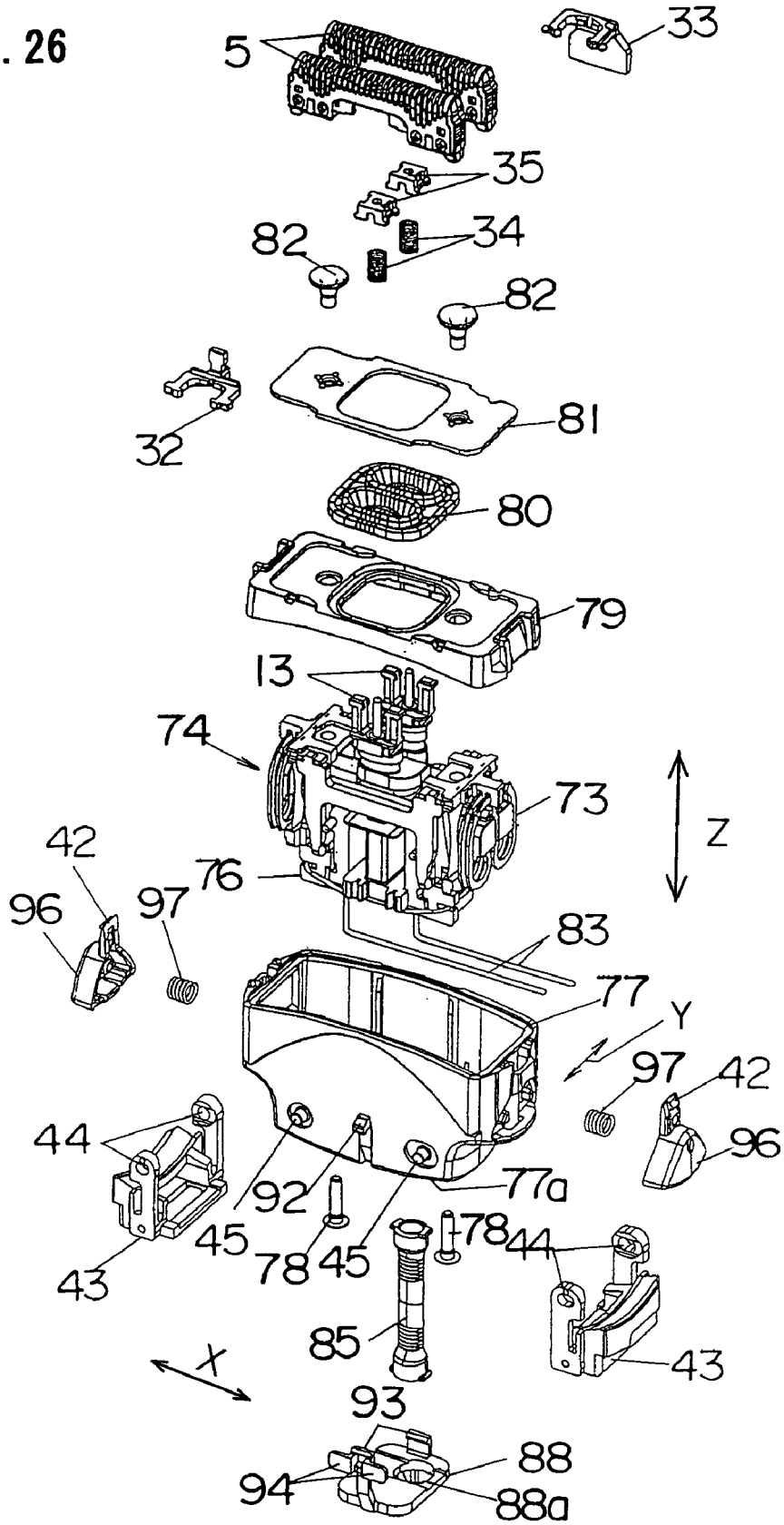
FIG. 26 is an exploded perspective view showing a configuration of a head case block of the shaver in accordance with the fourth embodiment.

Firstly, the structure of the head portion 3 will be described. The head portion 3, broadly divided, comprises a head case block 74 containing a linear motor 73, inner blades 5 and an outer blade block 75. The vibration of the linear motor 73 in the X-direction is transmitted to the inner blades 5 by driving elements 13 at top ends thereof. Due to the sliding of the inner blade 5 and the outer blade 4 on each other, the beard introduced into meshed blade holes of the outer blades 4 is cut off. As shown in FIG. 26, the linear motor 73 is inserted from above into a head case 77 in a state of being integrally coupled at its lower end to a motor base 76, and is fixed from below with head lower screws 78.

As shown in FIG. 26, a head case cover 79, a driving element waterproof rubber 80 and a rubber pressure plate 81 are fixed, in order from below upward, to the head case 77 with head upper screws 82. By fixing the respective components to the head case 77 with the screws, the head case block 74 is formed to be one housing having the linear motor 73 built therein. A packing or O-ring (not shown) for waterproof is provided below a lower surface of the head case cover 79, so that the head case block 77 is formed to be a waterproofed case.

Figure 24:
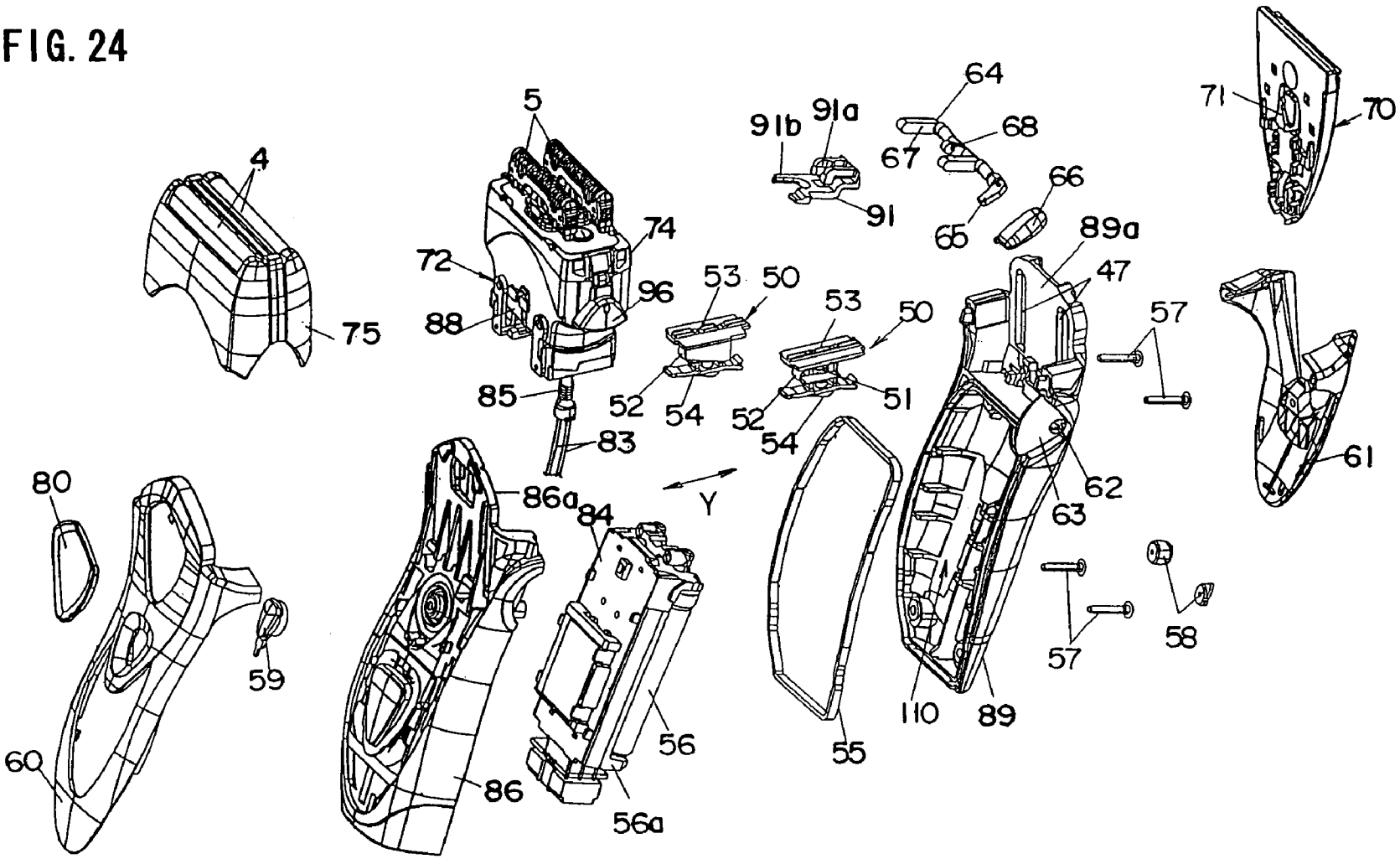
FIG. 24 is an exploded perspective view showing a configuration of the shaver in accordance with the fourth embodiment as seen from its front housing.

Lead wires 83 extending from below the linear motor 73 are to be connected at their ends to a driving circuit in the main body 2 in order to drive the linear motor 73. Hence, they pass through a hole (not shown) provided in a lower portion of the head case 77, and are inserted into and passed through a waterproof rubber tube 85, as shown in FIG. 24. They further pass through a hole 87 (refer to FIG. 27) provided in an upper surface of a later described front housing 86, and are connected to a circuit 84 in a box-like space 110 of the main body 2, which consists of a front housing 86 and a back housing 89.

An upper end of the rubber tube 85 is pressed and inserted into a tube hole (not shown) provided on a bottom surface of the head case 77, and then is latched from outside by a latch hole 88*a* (refer to FIG. 26) of a head latching member 88 which will be described later. A lower end of the rubber tube 85 is pressed and inserted into a tube hole for lead wire in an upper surface of the back housing 89, and then is inserted into and latched by a latch portion 91*b* (refer to FIG. 24) of a later described click member 91. That is, it is configured such that a waterproof structure is provided between the head portion 3 and the box-like space 110 of the main body 2, and further the head portion 3 is coupled to the main body 2 by the rubber tube 85, while the lead wires 83 are passed through in the rubber tube 85 so as to supply power from the main body 2 to the head portion 3 in waterproof condition. Accordingly, the head portion 3 can relatively widely move relative to the main body 2. Furthermore, since the head portion 3 and the main body 2 are waterproof, the inner blades 5 can be washed with water, thereby cleanability is increased.

As shown in FIG. 26, in the vicinity of a bottom center of the head case 77, a protruding portion 77*a* is formed in a manner so that it protrudes downward and decreases its width in the X-direction. Owing to a configuration which will be described later, the protruding portion 77*a* is supported to be swingable relative to a front wall 86*a* and a back wall 89*a* (refer to FIG. 24) of the main body 2, so that the head portion 3 can be swung on the X-Z plane relative to the main body 2, making it possible to increase the followability of the head (sic: correctly head portion) 3 to the skin. Furthermore, as can be seen from for example FIG. 20A, and so on, a gap is produced between the lower part of the head portion 3 at its both ends in the X-direction and the upper end of the main body 2, so that it becomes easier to check the movement of the head portion 3 when shaving. Furthermore, as shown in FIG. 20A, since a width dimension $L_2$ of the upper part of the main body 2 in the X-direction is made larger than a width dimension $L_1$ of the front wall 86*a* and the back wall 89*a*, the probability for a finger to enter the movable range of the lower side of the head portion 3 in a normal gripping state decreases significantly. Thereby, it is possible to realize a configuration to secure the grippability with fingers being prevented from contacting the head portion 3 and not to impede the movement of the head portion 3.

Subsequently, a mechanism to hold the head portion 3 in the Y-direction and a mechanism to prevent its rattles in the Y-direction will be described.

On the front wall 86*a*, the mechanism to hold the head portion 3 in the Y-direction is provided. In an example shown in FIG. 26, a pair of front and back latch projections 93 provided on the head latching member 88 are latched by projecting portions 92 provided on both front and back surfaces of the head case 77, so that the head latching member 88 is mounted on the head case block 74. Furthermore, at an upper end portion on the front side of the head latching member 88, projecting segments 94 projecting left and right are provided. The projecting segments 94 are fit into an opening 95 (refer to FIG. 27) provided in the front wall 86*a* of the front housing 86, whereby the projecting segments 94 of the head latching member 88 are latched to the front wall 86*a*. Thus, the head case block 74 is retained so as not to move in the Y-direction relative to the front housing 86. Accordingly, even if there are variations in pitch between the front wall 86*a* of the front housing 86 and the back wall 89*a* of the back housing 89, the head case block 74 is latched to the front wall 86*a*, thereby preventing the rattles in the Y-direction.

Figure 27:
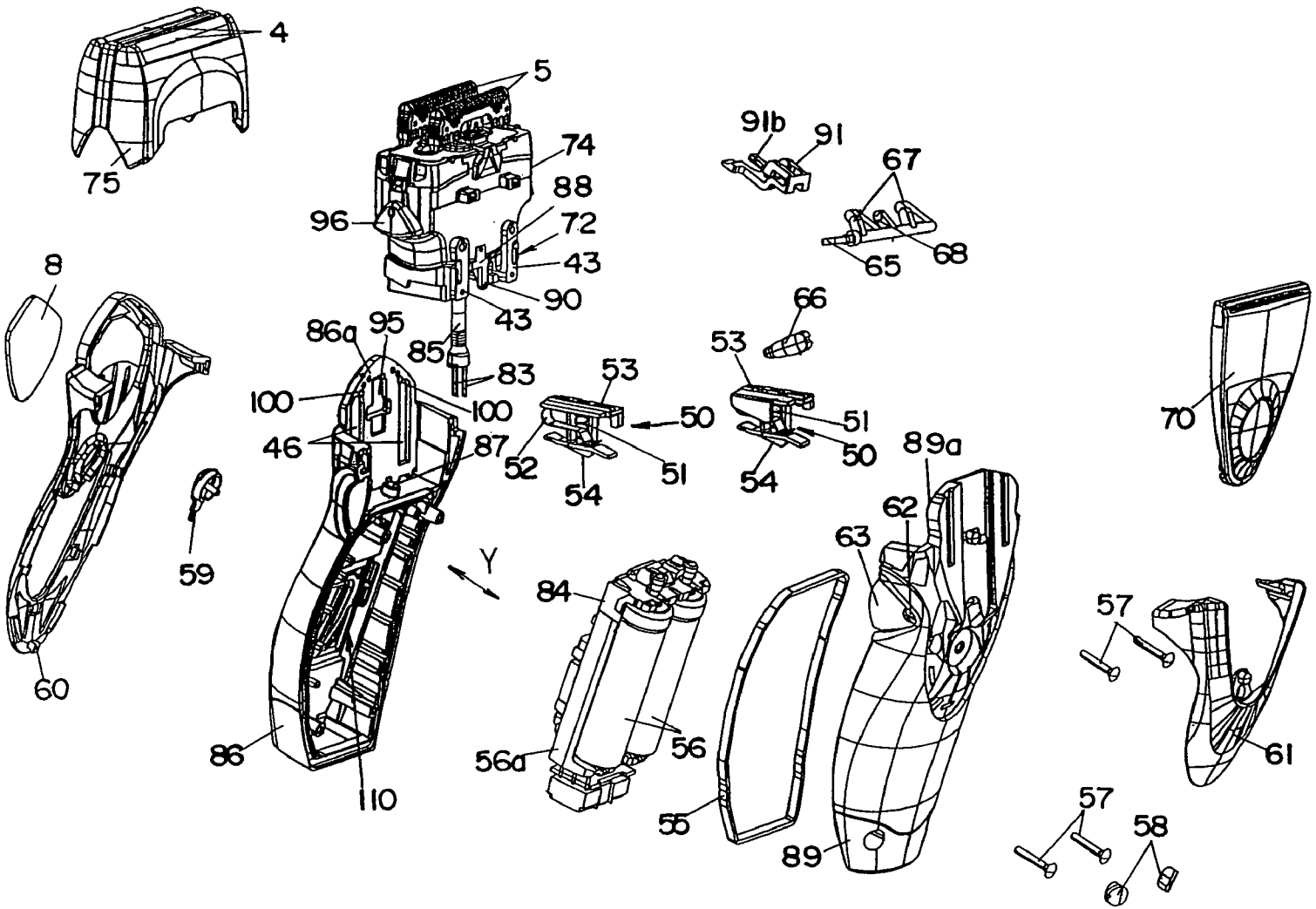
FIG. 27 is an exploded perspective view showing a configuration of the shaver in accordance with the fourth embodiment as seen from its back housing.

Furthermore, as shown in FIG. 27, a projecting portion 90 is provided to extend downward from a lower back part of the head latching member 88. This projecting portion 90 is in sliding contact with an inner surface of the back wall 89*a*, so that the head case block 74 is prevented from tilting in the Y-direction. That is, the head case block 74, in a state of not tilting in the Y-direction, is guided only in the Z-direction due to the sliding contact of the projecting portion 90 with the inner surface of the back wall 89*a* of the back housing 89. Accordingly, even if a force in the Y-direction is applied to the head portion 3 in shaving, the head portion 3 does not tilt in the Y-direction, so that it can be prevented from becoming difficult to shave due to tilting of head portions as in conventional shavers.

As shown in FIG. 26, blade attach/detach buttons 96 are provided on both end surfaces in the X-direction of the head case 77. Each blade attach/detach button 96 is mounted in a state of being biased outwardly by a blade attach/detach button spring 97.

Subsequently, the inner blades 5 will be described. As shown in FIG. 26, the driving elements 13 of the linear motor 73 are protruded upward from a hole at a center portion in an upper surface of the head case 77. A slit drive rod 32 and a trimmer drive rod 33 are mounted on the driving elements 13 from the front and the back. In the driving elements 13, inner blade push-up springs 34 are held by spring stoppers 35 from above of which the inner blades 5 are coupled, so that the inner blades 5 become biased upward.

Figure 25:
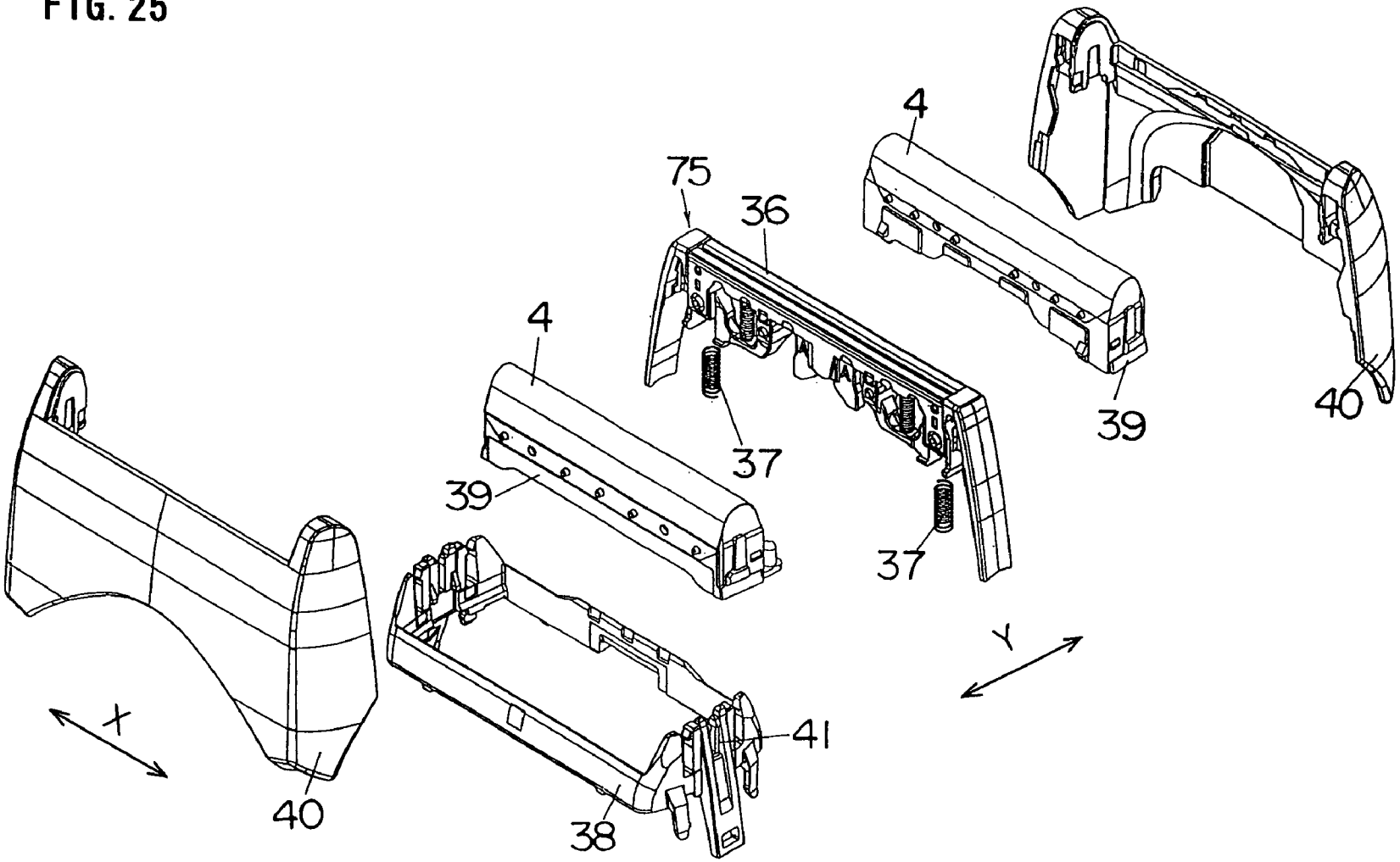
FIG. 25 is an exploded perspective view showing a configuration of an outer blade block of the shaver in accordance with the fourth embodiment.

Subsequently, the outer blade block 75 will be described. As shown in FIG. 25, three blades of an outer blade 4 (meshed blade), a slit blade 36 and an outer blade 4 (meshed blade) are arranged in this order in the Y-direction. They are held by a holding frame 38 so as to be floatable independently of each other by slit float springs 37. The outer blades 4 are fixed by outer blade frames 39, and the outer blade frames 39 are coupled to the holding frame 38 by blade cover members 40. Engaging holes 41 are provided on both ends in the X-direction of the holding frame 38. Engaging projections 42 (refer to FIG. 26) at upper portions of the blade attach/detach buttons 96 are engaged with the engaging holes 41, so that the outer blade block 75 is held by and detachably attached to the head case 77.

Subsequently, the structure of the head support block 72 will be described with reference to FIG. 19, FIG. 24, FIG. 26 and FIG. 27. As shown in FIG. 26, head support members 43 are each formed in a substantially U-shape such that two arms protrude in parallel in the Z-direction. Hole portions 44 are provided in upper top portions of the arms, respectively. On the other hand, support projections 45 protruding in the Y-direction are provided at two locations on the front and back walls of the head case 77, respectively, totaling four locations. The support projections 45 on the front and back are formed at positions on coaxes as seen from the front.

Two of the head support members 43 are provided left and right, with the hole portions 44 in the upper portions of the respective arms being engaged with the support projections 45 of the head case 77, so as to be rotatable and to be in a state of sandwiching, from below, the head case 77 from the front and back. As shown in FIG. 27, the respective head support members 43 are inserted and fit into pairs of left and right guide grooves 46 and 47 in a vertical groove pattern formed in the front wall 86*a* of the front housing 86 and the rear wall 89*a* of the back housing 89, respectively, whereby the head support members 43 are held in a state of being sandwiched between the front wall 86*a* and the rear wall 89*a* so as to be movable up and down.

Hereupon, the function based on the two head support members 43 provided left and right can be explained as follows. In the case where the head portion 3 is pressed at a different angle against the skin, a force to lower the head portion 3 downward is generated, with both ends of the head portion 3 being in contact with the skin. At this time, the fulcrum of the rotation of the head portion 3 increases its distance from the force point because the head support member 43 on a side opposite to the side contacting the skin serves as an axis, thereby the force to rotate the head portion 3 is increased. As a result, the head portion 3 rotates with a light force until a state where it gets in contact along the skin, so that the razor tightly contacts the skin.

Furthermore, as shown in FIG. 27, elastic members 100 made of an elastomer are arranged on an upper side of the guide grooves 46 of the front wall 86*a*. The elastic members 100 are provided on an upper end of the guide grooves 46, such that when the head support members 43 move along the guide grooves 46, the elastic members 100 mitigate shock at the time the head support members 43, then floating, return, so that they function to reduce shock to the hand and noise.

Subsequently, spring blocks 50 to bias the head support members 43 will be described. As shown in FIG. 24 and FIG. 27, two of the spring blocks 50 are provided left and right in correspondence with the respective head support members 43. In each spring block 50, a coil spring 51 and a plate spring 52 are held by upper and lower spring brackets 53 and 54. The coil spring 51 is held by projections (not shown) provided on the respective upper and lower spring brackets 53 and 54. The plate spring 52 is formed in a substantially U-shape and is fixed by welding a part thereof to the projection of the upper spring bracket 53. Two projections (not shown) are provided on the lower spring bracket 54 at positions located across the coil spring 51, and the spring block 50 is constructed by engaging hooks at ends thereof with holes (not shown) provided in the upper spring bracket 53.

The upper spring bracket 53 of the spring block 50 abuts against the lower surface of the head support member 43, while the lower spring bracket 54 abuts against the bottom surface of the box-like space 110 of the main body 2 formed by the front housing 86 and the back housing 89, so that the head support member 43 is supported from below by the spring block 50. By such a configuration, the waterproof head case block 74 can swing relatively largely. Furthermore, since the head support members 43 and the spring blocks 50 that constitute biasing elements are provided between the head portion 3 and the upper surface of the box-like space 110 of the main body 2, a slim main body 2 which is very easy to hold is realized with no influence on the thickness of the main body 2*b* due to the biasing elements, and the head portion 3 can be supported over the entirety of the lower surface of the head portion 3 in the Y-direction so that the action of the head portion 3 can be stabilized. Furthermore, since the head support members 43 rotatably coupled to the head portion 3 are held by the guide grooves 46 and 47 formed inside the front wall 86*a* and the back wall 89*a* of the housing so as to be movable up and down, and the head support members are biased by the spring blocks 50, it is a configuration that the head portion 3 can be swung and moved up and down, simultaneously.

Subsequently, a mechanism for adjusting the spring force of the spring blocks 50 will be described. As shown in FIG. 24 and FIG. 27, a fan-shaped planar portion 63 and a hole 62 are formed at an upper side portion on one side of the back housing 89. A lever shaft 64 is inserted into the hole 62. A projection 65 is provided on an end portion of the lever shaft 64, and a lever operation member 66 is coupled to the projection 65 which protrudes from the hole 62 to the planar 63 side. The lever operation member 66 is rotated at the planar portion 63 of the back housing 89. The lever shaft 64 is inserted into the inside of the spring blocks 50, and when the lever operation member 66 is moved by a user, the lever shaft 64 is rotated. Since projections 67 provided on the lever shaft 64 vary in height at the ends thereof according to the rotation angle of the lever shaft 64, the entire spring blocks 50 can expand and compress up and down (Z-direction) to vary the heights for the lower surfaces of the spring brackets 53 and for supporting the plate springs 52. Thereby, it is possible to adjust the floating amount and the floating force. Besides, a projection 68 having a spherical end is formed in the vicinity of the center of the lever shaft 64. The projection 68 is engaged with a groove 91*a* of a click member 91 mounted on the lever 64, so that it is possible to select the rotational position of the lever shaft 64 while obtaining the click feeling.

Subsequently, the main body 2 will be described with reference to FIG. 18, FIG. 19, FIG. 20A to FIG. 20C, FIG. 24 and FIG. 27. The main body 2 is mainly configured by the front housing 86 and the back housing 89 that are divided into two. The front housing 86 and the back housing 89 are coupled with an O-ring 55 (refer to FIG. 24 and FIG. 27) of rubber sandwiched therebetween, so that the waterproofable box-like space 110 is formed inside them. Furthermore, the front wall 86*a* and the back wall 89*a* extend upward in the Z-direction from the upper front and back ends of the box-like space 110, respectively, in which the respective inner surfaces of these front wall 86*a* and back wall 89*a* serve as a head holding portion. As shown in FIG. 24, a battery 56, a circuit 84, a base 56*a* to hold them, and so on are provided in the box-like space 110 formed inside the front housing 86 and the back housing 89. The front housing 86 and the back housing 89 are fixed with housing fixing screws 57 from back portion of the back housing 89. Besides, the holes to insert the housing fixing screws are covered with screw covers 58.

A front panel 60 is coupled to the front surface of the front housing 86 by hooks provided on the front surface with a switch 59 being sandwiched therebetween. A back panel 61 is coupled to the back surface of the back housing 89.

As shown by the dotted areas in FIG. 18, FIG. 20A to FIG. 20C, the anti slip portion 8 is integrally formed on the front housing 86 from both sides 2B to the lower half part $\mathbf{2}A_L$ of the front 2A. Further, the anti slip portion 8 made of an elastic material is integrally formed on the back housing 89 from both sides 2B to the lower half part $\mathbf{2}C_L$ of the back 2C. By coupling the front housing 86 to the back housing 89, the anti slip portion 8 is continuously provided on the main body 2 from the sides 2B to the lower half part $2C_L$ of the back 2C and from the sides 2B to the lower half part $2A_L$ of the front 2A so as to wrap around the main body 2.

As shown in FIG. 20A to FIG. 20C, FIG. 24 and FIG. 27, the trimmer block 70 is mounted on the back panel 61 so as to be slidable up and down. At its upper slide position, a trimmer driving member 71 shown in FIG. 24 is coupled to the trimmer drive rod 33 provided in the head portion 3 as shown in FIG. 26 so as to be driven.

This application is based on Japanese patent applications 2002-158079, 2002-176450 and 2002-318927, the contents of which are to be incorporated with the invention of this application consequently by referring to the specifications and the drawings of the above patent applications.

Although the invention of this application has been sufficiently described using embodiments with reference to the annexed drawings, it would be apparent to those having ordinary knowledge in the art that various alterations and modifications are possible. Accordingly, it should be interpreted that such alterations and modifications do not depart from the scope of the invention of this application but be included in the scope of the invention of this application.

INDUSTRIAL APPLICABILITY

As described above, in the shaver in accordance with the present invention, the shape of the front cross section of the shaver has a torso shape in which its width at a substantially center portion in the up and down direction is narrowed, while the shape of the side cross section of the shaver in its entirety has a substantially S-shape. Accordingly, when a user holds the shaver, the contact area of the main body of the shaver with a portion between the index finger and the thumb increases due to the back convex curved portion on the back of the shaver having the torso shape and the substantially S-shape. Furthermore, due to the back concave curved portion on the lower back part in the substantially S-shape, it is possible to increase its contact area with the hypothenar of the hand regardless of the size of the hand. As a result, the contact area with the hypothenar and the portion between the index finger and the thumb, which is important to stably hold the shaver, can be secured. In addition, when gripping and holding the shaver, the thenar fits the torso-shaped neck portion, so that it is possible to grip and hold it without unreasonable effort.

Furthermore, since the contact area between the index finger and the thumb is increased due to the back convex curved potion on the back of the substantially S-shaped shaver, it is possible to hold it with the middle finger, the ring finger and the little finger contacting along the opposite torso-shaped neck portion and lower bent portion of the substantially S-shape in a state where: the thumb and the index finger holds the shaver; the convex curve of the thenar fits the torso-shaped neck portion; and the hypothenar contacts along the back concave curved portion on the lower back part of the main body in the substantially S-shape. In such case, for finely adjusting the angle of the razor of the head portion of the shaver against the skin, it is possible to pivot the shaver slightly in the forward and backward direction or the left and right direction, using the part gripped by the thumb and the index finger as a fulcrum, in a manner that the middle finger, the ring finger, the little finger and the like contacting along the torso-shaped neck portion and the vicinity of the lower bent portion of the substantially S-shape press the neck portion and the vicinity of the lower bent portion of the substantially S-shape which is convex to the front. Hence, fine adjustment of the angle of the razor against the skin can be easily performed. Since the convex curve of the thenar fits the torso-shaped neck portion at this time, it is not necessary to strongly press the thenar against the side of the shaver, and the thenar does not impede the pivoting with the part gripped by the thumb and the index finger being used as a fulcrum, so that the fine adjustment can be easily performed without moving the wrist. As a result, the contact area of the palm and the respective fingers is secured, so that it is possible to improve fit feeling, make it hard to slip, make it easy to use, and, in particular, make it easy to finely adjust the angle of the razor against the skin.

The invention claimed is:

1. A shaver provided with a head portion comprising a razor having an outer blade and an inner blade on an upper end portion of a main body thereof, wherein:

a front cross section of the shaver in its entirety has a torso shape having a neck portion narrowed in width at a substantially center portion in an up and down direction of the shaver, and a side cross section of the shaver in its entirety has a substantially S-shape defined by an upper back convex curved portion and an upper front concave curved portion located above the neck portion, and a lower back concave curved portion and a lower front convex curved portion located below the neck portion;

a part of the main body functions as a grip portion for a user to hold the shaver by hand;

a side cross section of the part of the main body functioning as the grip portion has a substantially herringbone shape so that the vertex of the substantially herringbone shape protrudes forwardly;

a front cross section of the part of the main body functioning as the grip portion has a substantially ovoid shape having a larger curvature on the back side thereof than the curvature on the front side thereof; and the head portion is provided to extend, diagonally upward to a side of the vertex of the substantially herringbone shape, from an upper end of the part of the main body functioning as the grip portion.

2. The shaver in accordance with claim 1, wherein the neck portion in the torso shape of the front cross section of the shaver in its entirety is positioned between a vertex of an upper bent portion and a vertex of a lower bent portion in the substantially S-shape of the side cross section of the shaver in its entirety.

3. The shaver in accordance with claim 1, wherein the width of the neck portion in the torso shape of the front cross section of the shaver in its entirety is narrower than the width of the head portion, and has a minimum width at a lower end portion thereof.

4. The shaver in accordance with claim 1, wherein the inner blade provided in the head portion is a reciprocating blade.

5. The shaver in accordance with claim 1, wherein an anti slip portion is provided at least on the back and sides of the main body.

6. The shaver in accordance with claim 5, wherein an anti slip portion is further provided on the front of the main body.

7. The shaver in accordance with claim 5, wherein the anti slip portion is of an elastic material.

8. The shaver in accordance with claim 5, wherein a trimmer operation portion slidable up and down to operate a trimmer is provided on the back of the shaver;

the anti slip portion is provided on the trimmer operation portion; and the trimmer operation portion having the anti slip portion provided thereon is positioned in the vicinity of an upper bent portion of the substantially S-shape.

9. The shaver in accordance with claim 1, wherein the length ratio of short axis to long axis in the substantially ovoid shape is short axis: long axis≈1:1.5 in the vicinity of a position of middle finger when holding the main body.

10. The shaver in accordance with claim 1, wherein the inner blade provided in the head portion is a reciprocating blade, and a front face part and a back face part of the upper end portion of the main body are substantially flat.

11. A shaver provided with a head portion comprising a razor having an outer blade and an inner blade on an upper end portion of a main body thereof, wherein:

a front cross section of the shaver in its entirety has a torso shape having a neck portion narrowed in width at a substantially center portion in an up and down direction of the shaver, and a side cross section of the shaver in its entirety has a substantially S-shape;

a part of the main body functions as a grip portion for a user to hold the shaver by hand;

a side cross section of the part of the main body functioning as the grip portion has a substantially herringbone shape so that the vertex of the substantially herringbone shape protrudes forwardly; and the head portion is provided to extend diagonally upward to a side of the vertex of the substantially herringbone shape, from an upper end of the part of the main body functioning as the grip portion wherein a front cross section of the part of the main body functioning as the grip portion has a substantially ovoid shape having a larger curvature on the back side thereof than the curvature on the front side thereof.

12. The shaver in accordance with claim 11, wherein the neck portion in the torso shape of the front cross section of the shaver in its entirety is positioned between a vertex of an upper bent portion and a vertex of a lower bent portion in the substantially S-shape of the side cross section of the shaver in its entirety.

13. The shaver in accordance with claim 11, wherein the width of the neck portion in the torso shape of the front cross section of the shaver in its entirety is narrower than the width of the head portion, and has a minimum width at a lower end portion thereof.

14. The shaver in accordance with claim 11, wherein the inner blade provided in the head portion is a reciprocating blade.

15. The shaver in accordance with claim 11, wherein an anti slip portion is provided at least on the back and sides of the main body.

16. The shaver in accordance with claim 15, wherein an anti slip portion is further provided on the front of the main body.

17. The shaver in accordance with claim 15, wherein the anti slip portion is of an elastic material.

18. The shaver in accordance with claim 15, wherein a trimmer operation portion slidable up and down to operate a trimmer is provided on the back of the shaver;

the anti slip portion is provided on the trimmer operation portion; and the trimmer operation portion having the anti slip portion provided thereon is positioned in the vicinity of an upper bent portion of the substantially S-shape.

19. The shaver in accordance with claim 11, wherein the length ratio of short axis to long axis in the substantially ovoid shape is short axis: long axis≈1:1.5 in the vicinity of a position of middle finger when holding the main body.

20. The shaver in accordance with claim 11, wherein the inner blade provided in the head portion is a reciprocating blade, and a front face part and a back face part of the upper end portion of the main body are substantially flat.

* * * * *